US012000657B2

(12) United States Patent
Seo et al.

(10) Patent No.: US 12,000,657 B2
(45) Date of Patent: Jun. 4, 2024

(54) HEAT EXCHANGER

(71) Applicant: Samsung Electronics Co., Ltd., Suwon-si (KR)

(72) Inventors: Kang Tae Seo, Suwon-si (KR); Young In Son, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 179 days.

(21) Appl. No.: 17/419,211

(22) PCT Filed: Oct. 14, 2019

(86) PCT No.: PCT/KR2019/013435
§ 371 (c)(1),
(2) Date: Jun. 28, 2021

(87) PCT Pub. No.: WO2020/138666
PCT Pub. Date: Jul. 2, 2020

(65) Prior Publication Data

US 2022/0065543 A1 Mar. 3, 2022

(30) Foreign Application Priority Data

Dec. 28, 2018 (KR) ..... 10-2018-0172420

(51) Int. Cl.
*F28D 1/053* (2006.01)
*F28F 9/02* (2006.01)

(52) U.S. Cl.
CPC ..... *F28D 1/05391* (2013.01); *F28F 9/0212* (2013.01); *F28F 9/0248* (2013.01); *F28F 2250/06* (2013.01); *F28F 2275/04* (2013.01)

(58) Field of Classification Search
CPC ... F28D 1/05391; F28F 9/0212; F28F 9/0248; F28F 2250/06; F28F 2275/04
See application file for complete search history.

(56) References Cited

U.S. PATENT DOCUMENTS

2012/0103581 A1 5/2012 Seo et al.
2012/0103585 A1* 5/2012 Seo ..... F28F 9/0251 165/175

(Continued)

FOREIGN PATENT DOCUMENTS

DE 102011077755 A1 12/2012
EP 0762072 A2 3/1997

(Continued)

OTHER PUBLICATIONS

Supplementary European Search Report dated Dec. 22, 2021, in connection with European Application No. 19904391, 7 pages.

(Continued)

*Primary Examiner* — Raheena R Malik

(57) ABSTRACT

A heat exchanger according to a concept of the disclosure includes an inlet pipe, an outlet pipe, and a connecting pipe connecting a first header to a second header, to perform heat exchange while a refrigerant flows in one direction of a up direction or a down direction in the heat exchanger to thereby improve circulation of the refrigerant, wherein each of the first header and the second header includes a plurality of partitioned chambers therein to distribute the refrigerant several times according to a flow of the refrigerant passing through each chamber, thereby improving distribution and mixing of the refrigerant.

13 Claims, 24 Drawing Sheets

(56) References Cited

U.S. PATENT DOCUMENTS

| | | | | |
|---|---|---|---|---|
| 2013/0240185 | A1 | 9/2013 | Katoh | |
| 2014/0096944 | A1 | 4/2014 | Seo et al. | |
| 2014/0311714 | A1* | 10/2014 | Seo | F28F 1/12 165/109.1 |
| 2016/0209130 | A1* | 7/2016 | Seo | F28F 9/0253 |
| 2017/0122666 | A1* | 5/2017 | Jo | F28F 1/06 |
| 2018/0073809 | A1* | 3/2018 | Seo | F28D 1/0435 |
| 2022/0065543 | A1* | 3/2022 | Seo | F28F 9/0212 |

FOREIGN PATENT DOCUMENTS

| | | | |
|---|---|---|---|
| JP | H05-34090 | A | 2/1993 |
| JP | 2001-141382 | A | 5/2001 |
| JP | 2001-147095 | A | 5/2001 |
| JP | 4845987 | B2 | 12/2011 |
| JP | 5783815 | B2 | 9/2015 |
| KR | 10-2005-0050179 | A | 5/2005 |
| KR | 10-2008-0086084 | A | 9/2008 |
| KR | 10-2011-0136701 | A | 12/2011 |
| KR | 10-2012-0044849 | A | 5/2012 |
| KR | 10-2014-0045864 | A | 4/2014 |
| KR | 10-2016-0089808 | A | 7/2016 |

OTHER PUBLICATIONS

International Search Report dated Feb. 14, 2020 in connection with International Patent Application No. PCT/KR2019/013435, 2 pages.
Notice of Preliminary Rejection dated Jun. 16, 2023, issued in connection with Korean Patent Application No. 10-2018-0172420, 13 pages.
Notice of Patent Allowance dated Aug. 29, 2023, issued in connection with Korean Patent Application No. 10-2018-0172420, 3 pages.
Communication pursuant to Article 94(3) EPC dated Feb. 9, 2024, in connection with European Patent Application No. 19904391.0, 5 pages.

* cited by examiner

HEAT EXCHANGER

CROSS-REFERENCE TO RELATED APPLICATIONS

This application is a 371 of International Application No. PCT/KR2019/013435 filed on Oct. 14, 2019, which claims priority to Korean Patent Application No. 10-2018-0172420 filed on Dec. 28, 2018, the disclosures of which are herein incorporated by reference in their entirety.

BACKGROUND

1. Field

The present disclosure relates to a heat exchanger, and more particularly, to a heat exchanger with an improved refrigerant circulation and distribution structure.

2. Description of Related Art

Generally, a heat exchanger is an apparatus for heat-exchanging a refrigerant with outside air by including tubes along which the refrigerant flows to exchange heat with outside air, a heat exchange fin contacting the tubes to enlarge a radiating area, and a header with which both ends of the tubes communicate. The heat exchanger includes an evaporator or a condenser, and constructs a cooling cycle apparatus together with a compressor for compressing a refrigerant and an expansion valve for expanding a refrigerant.

The heat exchanger has an inlet pipe which an external refrigerant enters, wherein the refrigerant entered through the inlet pipe is distributed to a plurality of heat exchange tubes via the header. To raise heat exchange efficiency, a plurality of tubes may be arranged in two columns. During cooling (evaporation driving), upward (the opposite direction of gravity) and downward (the direction of gravity) flows of a refrigerant coexist, and, during heating (condensation driving), upward (the opposite direction of gravity) and downward (the direction of gravity) flow of a refrigerant also coexists in the opposite directions of the flows during cooling.

However, when upward flow is made during heating (condensation driving), condensate is generated in the tubes, and increases of viscosity and density caused by the condensate act as resistance against the upward flow of the refrigerant, which scatter refrigerant distribution in a distributor and deteriorate performance. For this reason, a structure for raising heat exchange efficiency and improving circulation and distribution of a refrigerant by causing a refrigerant in tubes to flow only downward during condensation driving is needed.

An aspect of the disclosure provides a heat exchanger capable of improving circulation of a refrigerant by causing the refrigerant to flow in one direction of a up direction or a down direction in the heat exchanger.

An aspect of the disclosure provides a heat exchanger capable of improving circulation of a refrigerant by causing the refrigerant in the heat exchanger to flow in the direction of gravity when the refrigerant is in a condensation condition and to flow in the opposite direction of gravity when the refrigerant is in an evaporation condition.

An aspect of the disclosure provides a heat exchanger in which a connecting pipe connecting an upper header to a lower header is integrated into the upper header and the lower header.

SUMMARY

A heat exchanger according to a concept of the disclosure includes: a plurality of heat exchange tubes along which a refrigerant flows to exchange heat with outside air, the plurality of heat exchange tubes including a plurality of tubes of a first column and a plurality of tubes of a second column; a first header to which upper ends of the plurality of heat exchange tubes are connected; a second header to which lower ends of the heat exchange tubes are connected; an inlet pipe which a refrigerant enters from outside; an outlet pipe through which a refrigerant is discharged to the outside; a first connecting pipe through which the refrigerant entered the inlet pipe flows to the first header; and a second connecting pipe through which a refrigerant flows from the second header to the first header without passing through the plurality of heat exchange tubes, wherein the first header, the second header, the first connecting pipe, and the second connecting pipe are coupled with each other by brazing.

At least one of the first header, the second header, the first connecting pipe, and the second connecting pipe may include a clad material for brazing coupling.

The first connecting pipe and the second connecting pipe may have a section of a rectangular shape.

The first connecting pipe and the second connecting pipe may be formed in a shape of a straight line. The first connecting pipe and the second connecting pipe may be connected to the first header and the second header at both ends.

The inlet pipe and the outlet pipe may protrude from the same side of the heat exchanger.

The first connecting pipe may be positioned behind the second connecting pipe. The inlet pipe may penetrate the second connecting pipe to be connected to the first connecting pipe.

The outlet pipe may be connected to the second connecting pipe or the second header.

The inlet pipe may be connected to the second header.

The heat exchanger may further include a third connecting pipe connecting the first connecting pipe to the second connecting pipe.

The inlet pipe may protrude from one end of the second header in a direction that is parallel to an extension direction of the second header.

The first header may include: a first chamber including a first sub chamber connected to the plurality of tubes of the first column and a second sub chamber connected to the first connecting pipe; a second chamber including a third sub chamber connected to the plurality of tubes of the second column and a fourth sub chamber connected to the second connecting pipe; a third chamber positioned above the first chamber and distributing a refrigerant to the first sub chamber; and a fourth chamber positioned above the second chamber and distributing a refrigerant to the third sub chamber. The second header may include: a fifth chamber including a fifth sub chamber connected to the plurality of tubes of the first column, and a sixth sub chamber isolated from the fifth sub chamber; a sixth chamber including a seventh sub chamber connected to the plurality of tubes of the second column, and an eighth sub chamber isolated from the seventh sub chamber; a seventh chamber positioned below the fifth chamber, wherein a refrigerant flown to the fifth sub chamber is collected in the seventh chamber; and an eighth chamber positioned below the sixth chamber.

The second connecting pipe may connect the sixth sub chamber to the fourth sub chamber.

The second connecting pipe may connect the eighth sub chamber to the fourth sub chamber.

The seventh chamber may include: a ninth sub chamber in which the refrigerant flown to the fifth sub chamber is collected; and a tenth sub chamber isolated from the ninth sub chamber, and communicating with the sixth sub chamber. The eighth chamber may communicate with the eighth sub chamber and the ninth sub chamber. The inlet pipe may penetrate the eighth chamber to be connected to the tenth sub chamber. The outlet pipe may be connected to the seventh sub chamber.

The eighth chamber may include: a ninth sub chamber in which the refrigerant flown to the seventh sub chamber is collected; and a tenth sub chamber isolated from the ninth sub chamber, and communicating with the eighth sub chamber. The tenth sub chamber may communicate with the seventh chamber and the eighth sub chamber. The inlet pipe may be connected to the sixth sub chamber. The outlet pipe may be connected to the ninth sub chamber.

A heat exchanger according to a concept of the disclosure includes: a plurality of heat exchange tubes including a plurality of tubes of a first column and a plurality of tubes of a second column; a first header to which upper ends of the plurality of heat exchange tubes are connected; a second header to which lower ends of the heat exchange tubes are connected; an inlet pipe which a refrigerant enters from outside; a first connecting pipe through which the refrigerant entered the inlet pipe is supplied to the first header; and a second connecting pipe through which a refrigerant flown from the first header to the second header through the plurality of tubes of the first column is again supplied to the first header; and an outlet pipe through which the refrigerant flown from the first header to the second header through the plurality of tubes of the second column is discharged to outside. The first header, the second header, the first connecting pipe, and the second connecting pipe may be coupled with each other by brazing.

The first header may include: a first chamber connected to upper ends of the plurality of tubes of the first column, a second chamber connected to upper ends of the plurality of tubes of the second column, a third chamber positioned above the first chamber and communicating with the first chamber, and a fourth chamber positioned above the second chamber and communicating with the second chamber. The second header may include: a fifth chamber connected to lower ends of the plurality of tubes of the first column, a sixth chamber connected to lower ends of the plurality of tubes of the second column, a seventh chamber positioned below the fifth chamber and communicating with the fifth chamber, and an eighth chamber positioned below the sixth chamber and communicating with the sixth chamber. The first connecting pipe may connect the first chamber to the fifth chamber. The second connecting pipe may connect the second chamber to the sixth chamber.

The heat exchanger may further include a third connecting pipe connecting the first connecting pipe to the second connecting pipe. A refrigerant flown to the fifth chamber through the plurality of tubes of the first column may pass through the first connecting pipe, the third connecting pipe, and the second connecting pipe sequentially, and then be supplied to the second chamber.

The fifth chamber may include a first sub chamber connected to the plurality of tubes of the first column, and a second sub chamber connected to the first connecting pipe. The sixth chamber may include a third sub chamber connected to the plurality of tubes of the second column, and a fourth sub chamber connected to the second connecting pipe. The seventh chamber may include a fifth sub chamber communicating with the first sub chamber and a sixth sub chamber communicating with the second sub chamber. The fifth sub chamber may communicate with the eighth chamber. A refrigerant flown to the first sub chamber through the plurality of tubes of the first column may pass through the fifth sub chamber, the eighth chamber, the fourth sub chamber, and the second connecting pipe sequentially, and then be supplied to the second chamber.

The fifth chamber may include a first sub chamber connected to the plurality of tubes of the first column, and a second sub chamber connected to the first connecting pipe. The sixth chamber may include a third sub chamber connected to the plurality of tubes of the second column, and a fourth sub chamber connected to the second connecting pipe. The eighth chamber may include a fifth sub chamber communicating with the third sub chamber, and a sixth sub chamber communicating with the fourth sub chamber. The sixth sub chamber may communicate with the seventh chamber. A refrigerant flown to the first sub chamber through the plurality of tubes of the first column may pass through the seventh chamber, the sixth chamber, the fourth chamber, and the second connecting pipe sequentially, and then be supplied to the second chamber.

DETAILED DESCRIPTION

Figure 1:
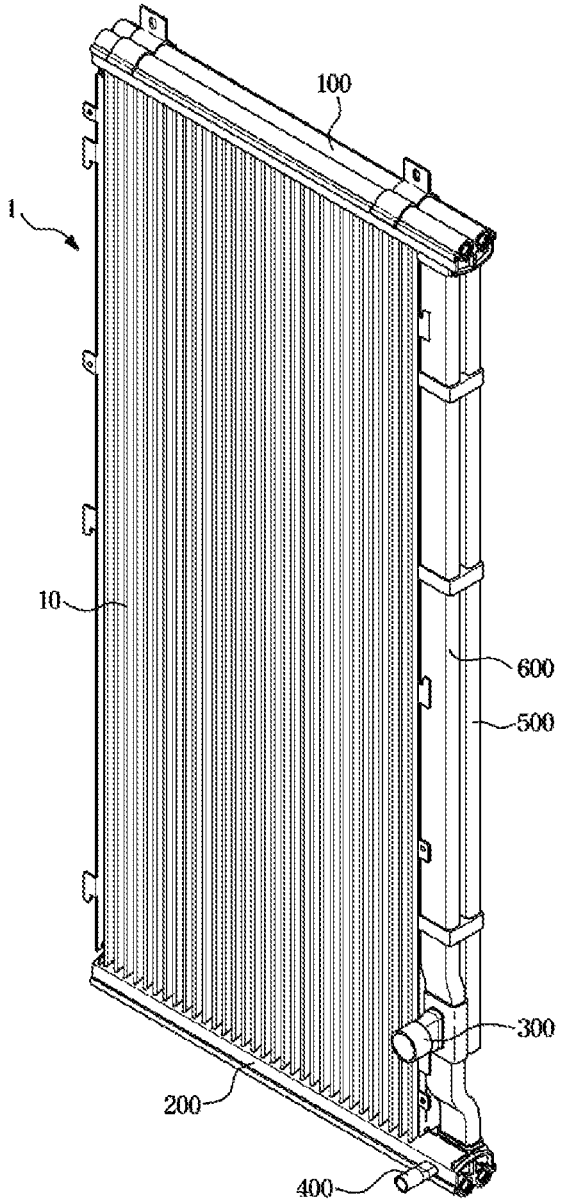
FIG. 1 is a perspective view illustrating an outer appearance of a heat exchanger according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions. In the drawings, for easy understanding, the shapes or sizes of components are more or less exaggeratedly shown.

The terms used in the present specification are merely used to describe embodiments, and are not intended to limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combination thereof, but do not preclude the presence or addition of one or more other features, figures, steps, operations, components, members, or combinations thereof.

Also, it will be understood that, although the terms "first", "second", etc. may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

Hereinafter, preferred embodiments of the disclosure will be described in detail with reference to the accompanying drawings.

FIG. 1 is a perspective view illustrating an outer appearance of a heat exchanger according to an embodiment of the disclosure.

Referring to FIG. 1, a heat exchanger 1 according to an embodiment of the disclosure may include a plurality of heat exchange tubes 10 along which a refrigerant flows to exchange heat with outside air, a first header 100 and a second header 200 with which the plurality of heat exchange tubes 10 communicate respectively, an inlet pipe 300 through which an external refrigerant enters upon driving of a heating cycle and a refrigerant is discharged to outside upon driving of a cooling cycle, an outlet pipe 400 through which a refrigerant is discharged to outside upon driving of the heating cycle and an external refrigerant enters upon driving of the cooling cycle, a first connecting pipe 500 connecting the inlet pipe 300 to the first header 100, and a second connecting pipe 600 connecting the first header 100 to the second header 200.

The heat exchange tubes 10 may have a plurality of micro channels along which a refrigerant can flow. The heat exchange tubes 10 may be formed in a flat shape. The heat exchange tubes 10 may be arranged in two columns of a front column 12 and a rear column 11 (see FIG. 4). The heat exchange tubes 10 may extend vertically. The heat exchange tubes 10 may be compression-molded with an aluminum material.

Although not shown in the drawings, a heat exchange fin which is in contact with the heat exchange tubes 10 may be interposed between the heat exchange tubes 10 to enlarge a heat transfer area with respect to outside air. The heat exchange fin may be in contact with the heat exchange tubes 10. The heat exchange fin may be one of various well-known types such as a corrugated fin, and may have a louver for improving heat transfer and drainage performance. The heat exchange fin may be made of an aluminum material and brazing-coupled with the heat exchange tubes 10.

The first header 100 may be spaced a preset distance from the second header 200, and the heat exchange tubes 10 may be positioned between the first header 100 and the second header 200. The first header 100 may be positioned at upper ends of the heat exchange tubes 10, and the second header 200 may be positioned at lower ends of the heat exchange tubes 10.

One inlet pipe 300, one outlet pipe 400, one first connecting pipe 500, and one second connecting pipe 600 may be provided. A refrigerant may enter the first connecting pipe 500 through the inlet pipe 300 to be supplied to the first header 100, and a refrigerant may be discharged to outside from the second header 200 through the outlet pipe 400. Also, a refrigerant may flow from the second header 200 to the first header 100 through the second connecting pipe 600 without passing through the heat exchange tubes 10.

The first header 100, the second header 200, the first connecting pipe 500, and the second connecting pipe 600 may be integrated into one body by brazing. For brazing coupling, at least one of the first header 100, the second header 200, the first connecting pipe 500, and the second connecting pipe 600 may include a clad material.

The first connecting pipe 500 may be positioned behind the second connecting pipe 600. The inlet pipe 300 may penetrate the second connecting pipe 600 to be connected to the first connecting pipe 500. The inlet pipe 300 and the outlet pipe 400 may protrude from the same side (front or rear side) of the heat exchanger 1. Because the inlet pipe 300 and the outlet pipe 400 protrude from the same side, it may be possible to easily perform brazing coupling after stably laying the heat exchanger 1 on the floor.

A diameter of the inlet pipe 300 may be larger than that of the outlet pipe 400. A high-temperature and high-pressure gas-phase refrigerant passed through a compressor (not shown) may enter the inlet pipe 300. The refrigerant entered the inlet pipe 300 may pass through the heat exchange tubes 10 to lose heat from outside and be condensed, and the condensed refrigerant may be discharged to the outside through the outlet pipe 400. Accordingly, in such a heating cycle, the heat exchanger 1 may function as a condenser.

In contrast, a low-temperature and low-pressure liquid-phase or gas-phase refrigerant passed through an expansion valve (not shown) may enter through the outlet pipe 400, and pass through the heat exchange tubes 10 to take away heat from outside and be evaporated. The evaporated refrigerant may be discharged to the outside through the inlet pipe 300. Accordingly, in such a cooling cycle, the heat exchanger 1 may function as an evaporator.

Hereinafter, a case in which the heat exchanger 1 according to an embodiment of the disclosure is used as a condenser will be mainly described. However, in the case in which a refrigerant circulates in the reverse cycle described above, the heat exchanger 1 may be used as an evaporator.

Figure 2:
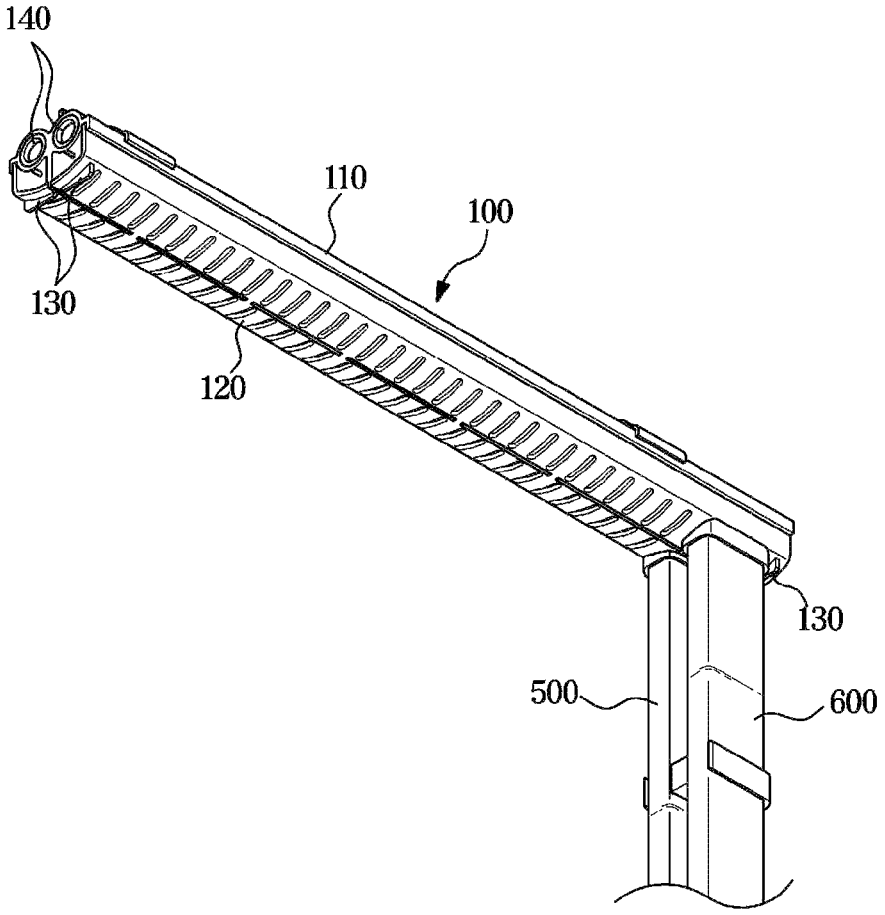
FIG. 2 is a perspective view illustrating an outer appearance of a first header of the heat exchanger of FIG. 1.
Figure 3:
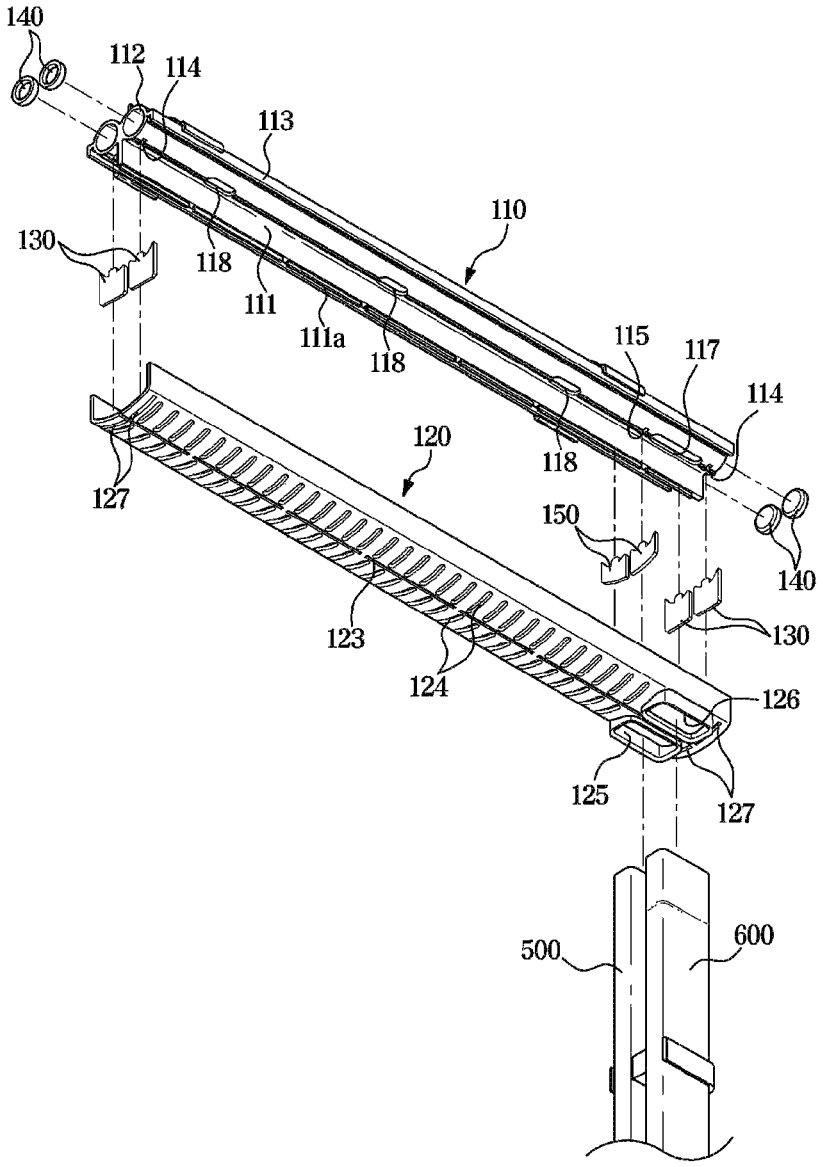
FIG. 3 is an exploded perspective view illustrating a configuration of the first header of the heat exchanger of FIG. 1.
Figure 4:
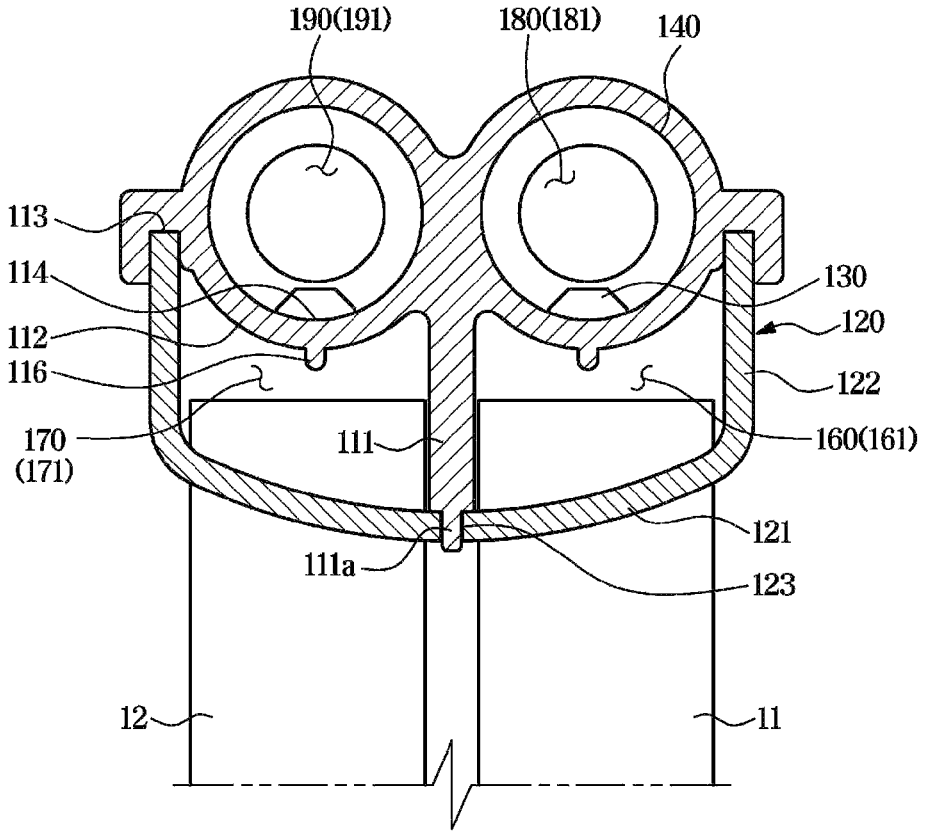
FIG. 4 is a side cross-sectional view of the first header of the heat exchanger of FIG. 1.
Figure 5:
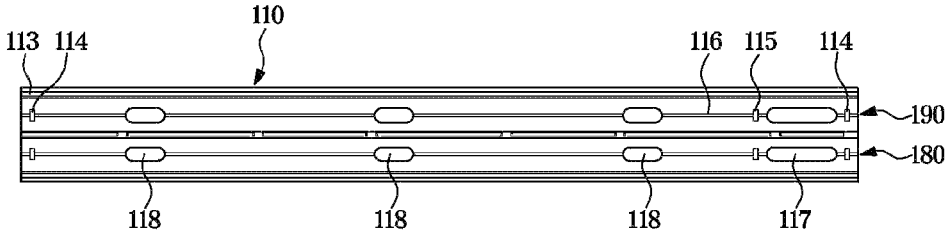
FIG. 5 is a top view illustrating an outer appearance of a body of the first header of the heat exchanger of FIG. 1.

FIG. 2 is a perspective view illustrating an outer appearance of the first header of the heat exchanger of FIG. 1, FIG. 3 is an exploded perspective view illustrating a configuration of the first header of the heat exchanger of FIG. 1, FIG. 4 is a side cross-sectional view of the first header of the heat exchanger of FIG. 1, and FIG. 5 is a top view illustrating an outer appearance of a body of the first header of the heat exchanger of FIG. 1.

Referring to FIGS. 2 to 5, the first header 100 of the heat exchanger 1 according to an embodiment of the disclosure may include a body 110, a cover 120 coupled with the body 110, and a plurality of chambers 160, 170, 180, and 190 which are formed by the body 110 and the cover 120 and along which a refrigerant flows.

The body 110 may include a wall 112, and a central partition wall 111 protruding from a center of the wall 112. The cover 120 may include a lower wall 121, and a side wall 122 extending from both sides of the lower wall 121.

In the wall 112, a coupling groove 113 may be formed, and an end of the side wall 112 of the cover 120 may be inserted in the coupling groove 113. Thereby, the body 110 may be firmly coupled with the cover 120. Both the body 110 and the cover 120 may be made of an aluminum material, wherein the body 110 may be made of an extruded material, and the cover 120 may be made of a clad material. The body 110 may be brazing-coupled with the cover 120.

The chambers 160, 170, 180, and 190 may include a first chamber 160 and a second chamber 170 formed by the central partition wall 111 and the cover 120, and a third chamber 180 and a fourth chamber 190 formed by the wall 112 inside the body 110.

A plurality of(삽입?) heat exchange tubes 11 of a first column may be connected to the first chamber 160, and a plurality of heat exchange tubes 12 of a second column may be connected to the second chamber 170. The first chamber 160 may be connected to the first connecting pipe 500, and the second chamber 170 may be connected to the second connecting pipe 600. A refrigerant entered through the inlet pipe 300 and the first connecting pipe 500 may be supplied to the first chamber 160, and a refrigerant may also enter the second chamber 170 through the second connecting pipe 600.

In a center of the lower wall 121, a coupling hole 123 may be formed, and at a lower end of the central partition wall 111, a coupling protrusion 111*a* to be inserted into the coupling hole 123 may be formed. Accordingly, the coupling protrusion 111*a* may be inserted into the coupling hole 123 to ultimately isolate the first chamber 160 from the second chamber 170.

A plurality of cover baffles 130 may be respectively coupled with both ends of the first header 100 to close left and right ends of the first chamber 160 and the second chamber 170. The cover baffles 130 may be inserted in cover baffle holes 114 and 127 respectively formed in the body 110 and the cover 120 to be coupled with the first header 100. The cover baffles 130 may be brazing-coupled with the first header 100. The cover baffles 130 may have the same shape and perform the same function.

A plurality of caps 140 may be respectively coupled with both ends of the body 110 to close left and right ends of the third chamber 180 and the fourth chamber 190. The caps 140 may be brazing-coupled with the first header 100. The caps 140 may have the same shape and perform the same function.

In the cover 120, a plurality of tube holes 124 in which the heat exchange tubes 10 are inserted may be formed. In the cover 120, a first connecting pipe hole 125 through which a refrigerant entered through the first connecting pipe 500 passes, and a second connecting pipe hole 126 through which a refrigerant entered through the second connecting pipe 600 passes may be formed. The body 110 may include a tube stopper 116 for limiting an insertion depth of the heat exchange tubes 10. The tube stopper 116 may protrude from a lower outer surface of the wall 112, and prevent the heat exchange tubes 10 from being excessively inserted into insides of the first chamber 160 and the second chamber 170.

Figure 10:
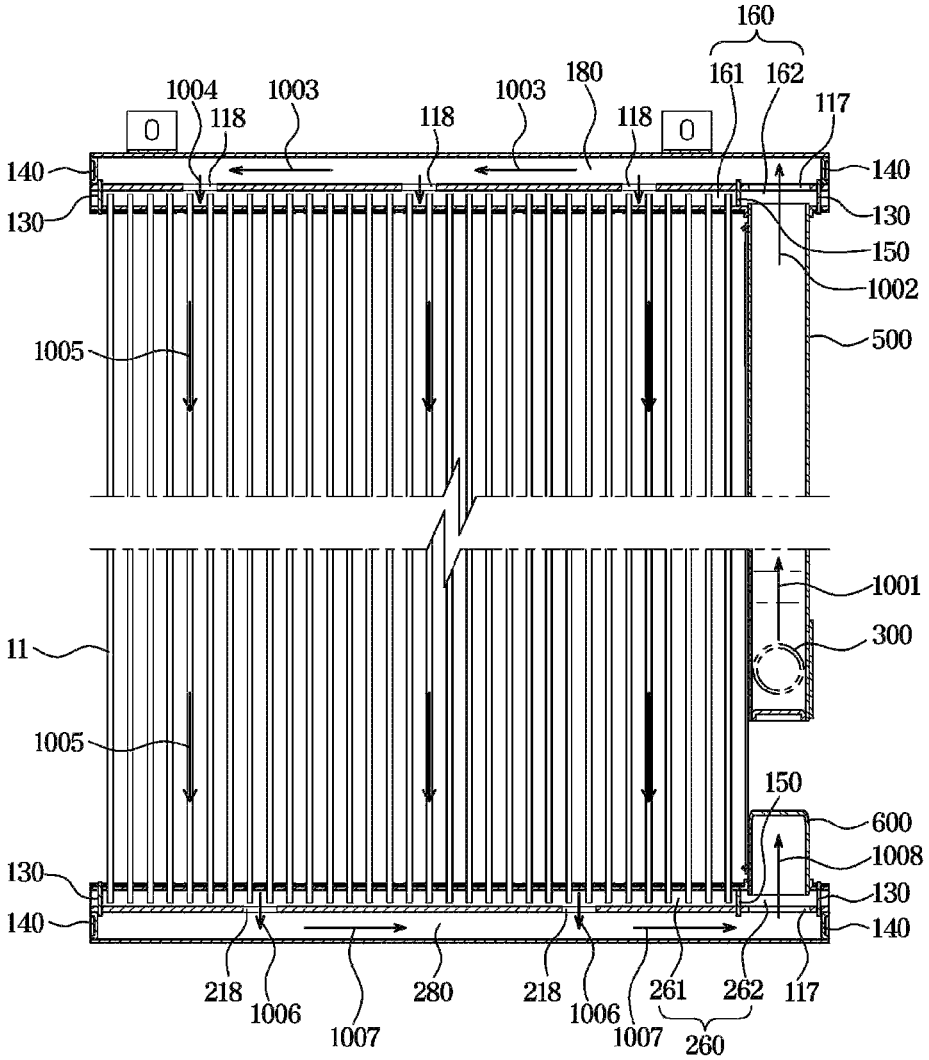
FIG. 10 is a front cross-sectional view illustrating flow of a refrigerant passing through tubes of a first column of the heat exchanger of FIG. 1.
Figure 12:
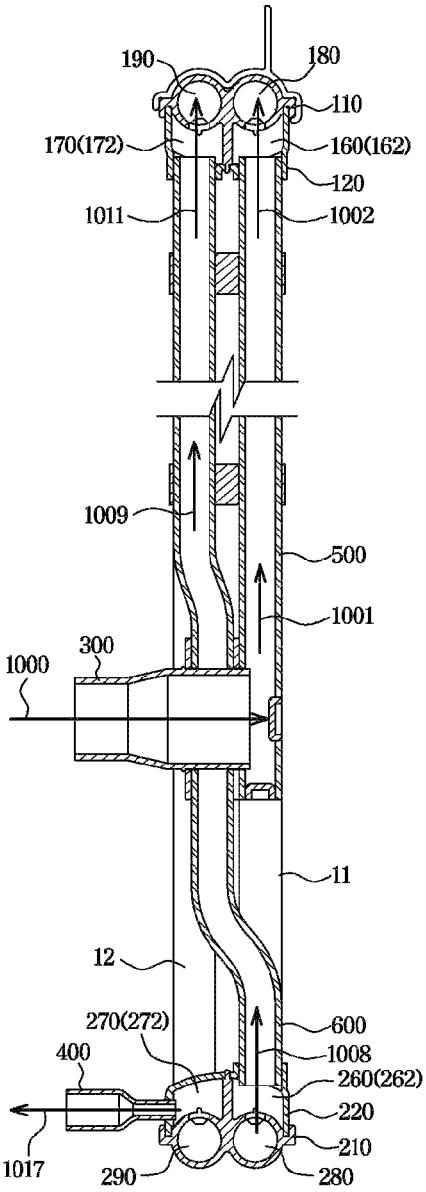
FIG. 12 is a side cross-sectional view illustrating flow of a refrigerant passing through a first connecting pipe and a second connecting pipe of the heat exchanger of FIG. 1.

The first chamber 160 may be partitioned into a first sub chamber 161 and a second sub chamber 162 by a partition baffle 150 coupled with the first header 100 (see FIGS. 10 and 12). The second chamber 170 may be partitioned into a first sub chamber 171 and a second sub chamber 172 by the partition baffle 150 coupled with the first header 100 (see FIGS. 10 and 12). The partition baffle 150 may be inserted in a partition baffle hole 115 formed in the body 110 to be coupled with the first header 100. The partition baffle 150 may be brazing-coupled with the first header 100.

The heat exchange tubes 11 of the first column (rear column) may be connected to the first sub chamber 161 of the first chamber 160, and the first connecting pipe 500 may be connected to the second sub chamber 162 of the first chamber 160. The heat exchange tubes 12 of the second column (front column) may be connected to the first sub chamber 171 of the second chamber 170, and the second connecting pipe 600 may be connected to the second sub chamber 172 of the second chamber 170.

The body 110 may include a through hole 117 through which a refrigerant entered the second sub chamber 162 of the first chamber 160 flows to the third chamber 180. The body 110 may include at least one distribution hole 118 through which a refrigerant entered the third chamber 180 enters the first sub chamber 161 of the first chamber 160.

The body 110 may include a through hole 117 through which a refrigerant entered the second sub chamber 172 of the second chamber 170 flows to the fourth chamber 190. The body 110 may include at least one distribution hole 118 through which a refrigerant entered the fourth chamber 190 enters the first sub chamber 171 of the second chamber 170.

Lengths of the through hole 117 and the distribution hole 118 in a longitudinal direction of the first header 100 may be longer than those of the through hole 117 and the distribution hole 118 in a width direction of the first header 100. One through hole 117 may be formed in each of the third chamber 180 and the fourth chamber 190, and a plurality of distribution holes 118 may be formed at preset intervals in each of the first chamber 160 and the second chamber 170.

A refrigerant entered the third chamber 180 may flow to the first sub chamber 161 of the first chamber 160 through the distribution hole 118, and may be equally distributed to the heat exchange tubes 11 of the first column. A refrigerant entered the fourth chamber 190 may flow to the first sub chamber 171 of the second chamber 170 through the distribution hole 118, and may be equally distributed to the heat exchange tubes 12 of the second column.

As a result, a refrigerant entered the first chamber 160 through the first connecting pipe 500 may be uniformly dispersed and distributed to the heat exchange tubes 11 of the first column, and a refrigerant entered the second chamber 170 through the second connecting pipe 600 may be uniformly dispersed and distributed to the heat exchange tubes 12 of the second column.

Also, refrigerants entered the second sub chamber 162 of the first chamber 160 and the second sub chamber 172 of the second chamber 170 may be mixed and stabilized in the second sub chamber 162 of the first chamber 160 and the second sub chamber 172 of the second chamber 170, before flowing to inside spaces of the third chamber 180 and the fourth chamber 190. Accordingly, distribution and heat exchange efficiency of refrigerants may increase.

Figure 6:
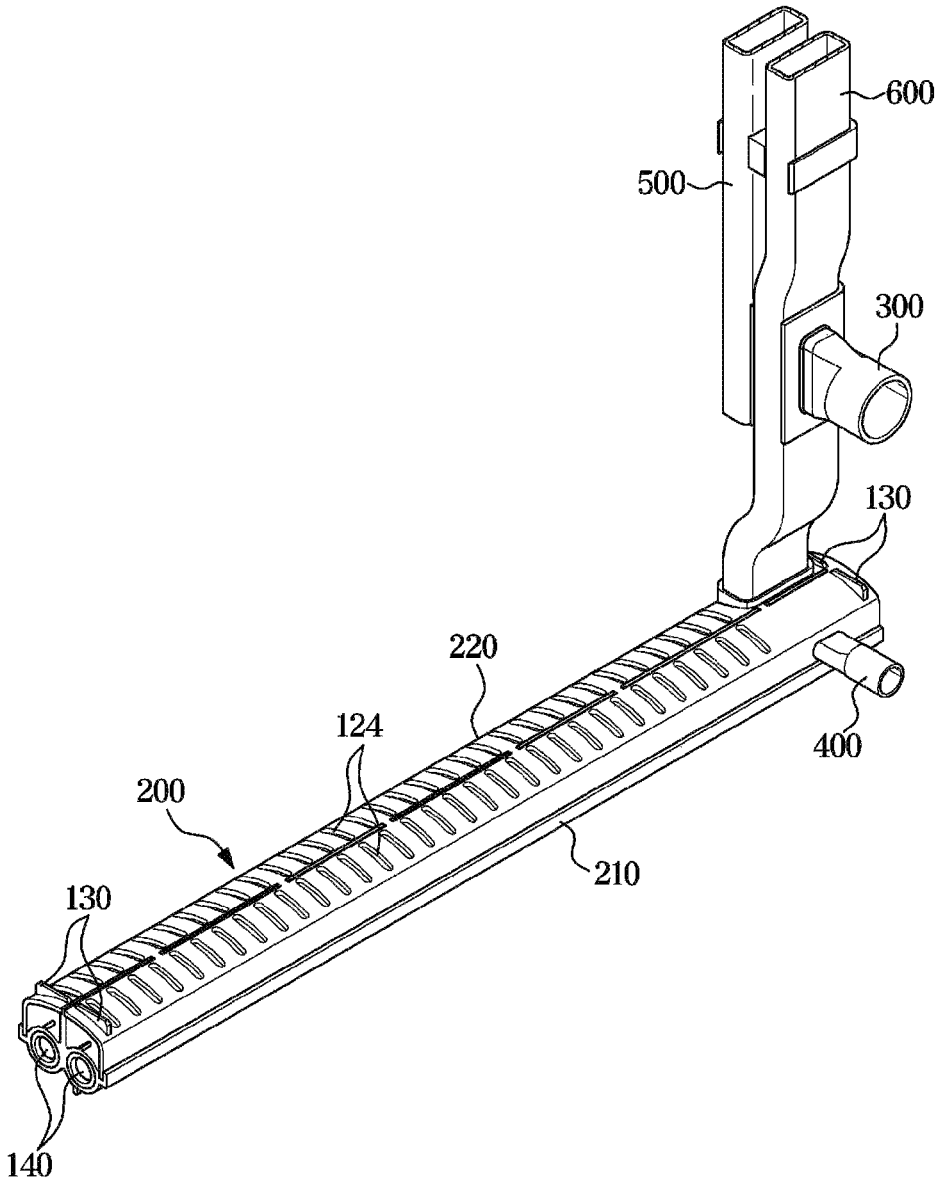
FIG. 6 is a perspective view illustrating an outer appearance of a second header of the heat exchanger of FIG. 1.
Figure 7:
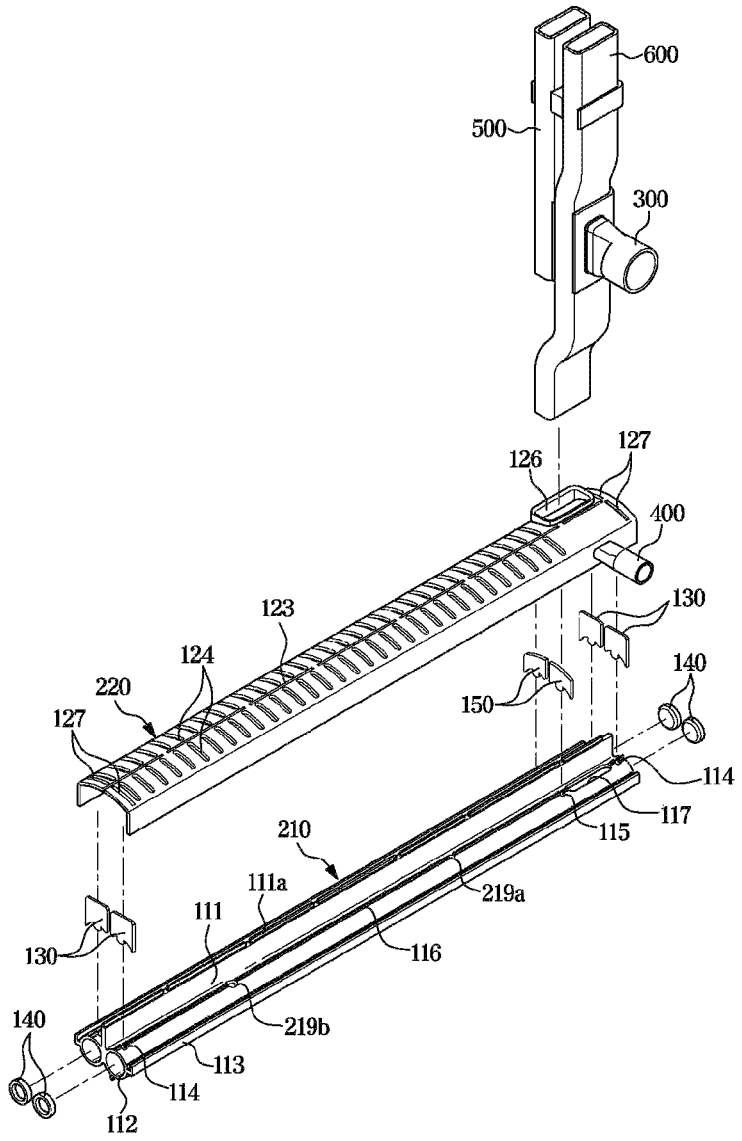
FIG. 7 is an exploded perspective view illustrating a configuration of the second header of the heat exchanger of FIG. 1.
Figure 8:
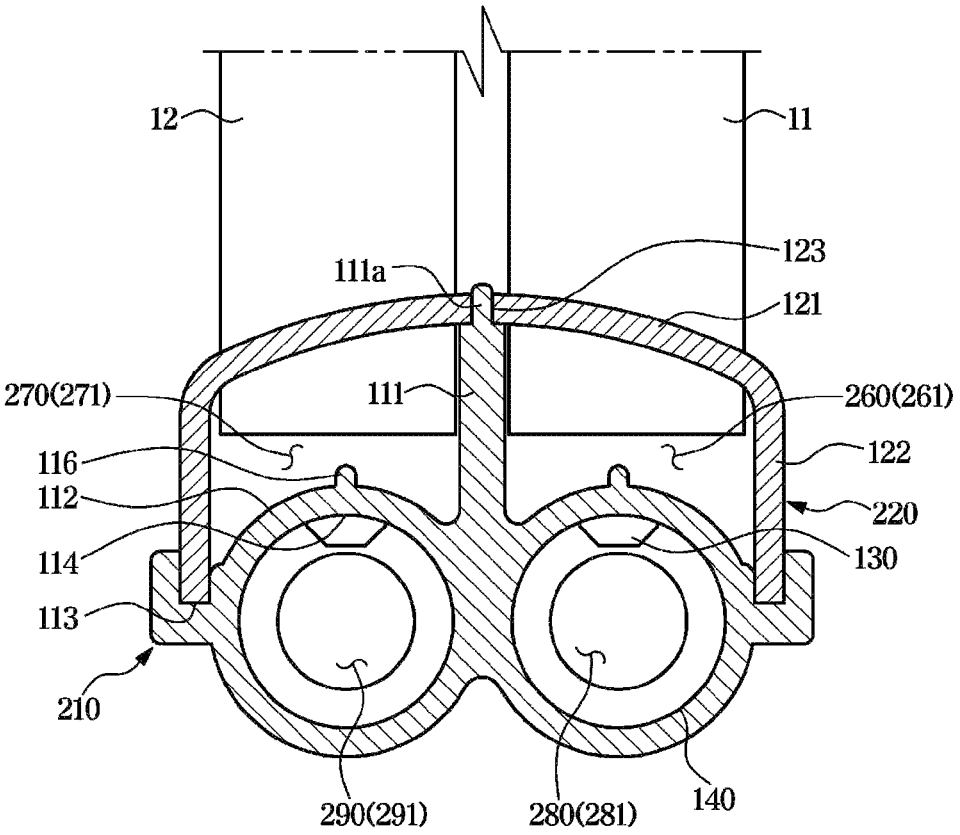
FIG. 8 is a side cross-sectional view of the second header of the heat exchanger of FIG. 1.
Figure 9:
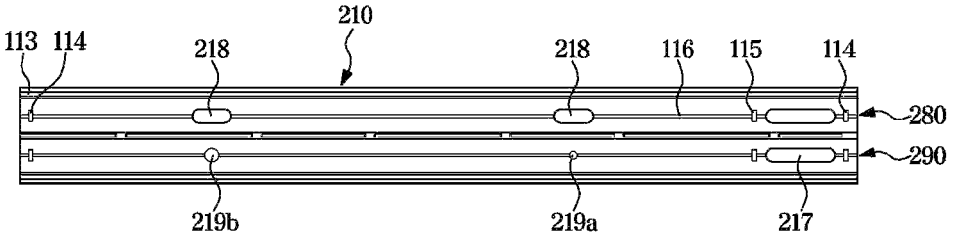
FIG. 9 is a top view illustrating an outer appearance of a body of the second header of the heat exchanger of FIG. 1.

FIG. 6 is a perspective view illustrating an outer appearance of the second header of the heat exchanger of FIG. 1, FIG. 7 is an exploded perspective view illustrating a configuration of the second header of the heat exchanger of FIG. 1, FIG. 8 is a side cross-sectional view of the second header of the heat exchanger of FIG. 1, and FIG. 9 is a top view illustrating an outer appearance of a body of the second header of the heat exchanger of FIG. 1.

Referring to FIGS. 6 to 9, the second header 200 of the heat exchanger 1 according to an embodiment of the disclosure may include a body 210, a cover 220 coupled with the body 210, and a plurality of chambers 260, 270, 280, and 290 which are formed by the body 210 and the cover 220 and along which a refrigerant flows.

The body 210 of the second header 200 may include a wall 112, and a central partition wall 111 protruding from a center of the wall 112. The cover 220 may include an upper wall 121, and a side wall 122 extending from both sides of the upper wall 121.

In the wall 112, a coupling groove 113 may be formed, and an end of the side wall 112 of the cover 220 may be inserted in the coupling groove 113. Thereby, the body 210 may be firmly coupled with the cover 220. Both the body 210 and the cover 220 may be made of an aluminum material, wherein the body 210 may be made of an extruded material, and the cover 220 may be made of a clad material. The body 210 may be brazing-coupled with the cover 220.

The chambers 260, 270, 280, and 290 may include a fifth chamber 260 and a sixth chamber 270 formed by the central partition wall 111 and the cover 220, and a seventh chamber 280 and an eighth chamber 290 formed by the wall 112 inside the body 210.

The heat exchange tubes 11 of the first column may be connected to the fifth chamber 260, and the heat exchange tubes 12 of the second column may be connected to the sixth chamber 270. The fifth chamber 260 may be connected to the second connecting pipe 600, and the sixth chamber 270 may be connected to the outlet connecting pipe 400. A refrigerant may flow from the fifth chamber 260 through the second connecting pipe 600, and a refrigerant may be discharged from the sixth chamber 270 through the outlet pipe 400.

In a center of the upper wall 121, a coupling hole 123 may be formed, and in a lower end of the central partition wall 111, a coupling protrusion 111*a* to be inserted into the coupling hole 123 may be formed. Accordingly, the coupling protrusion 111*a* may be inserted into the coupling hole 123 to ultimately isolate the fifth chamber 260 from the sixth chamber 270.

A plurality of cover baffles 130 may be respectively coupled with both ends of the second header 200 to close left and right ends of the fifth chamber 260 and the sixth chamber 270. The cover baffles 130 may be inserted in cover baffle holes 114 and 127 respectively formed in the body 210 and the cover 220 to be coupled with the second header 200. The cover baffles 130 may be brazing-coupled with the second header 200. The cover baffles 130 may have the same shape and perform the same function.

A plurality of caps 140 may be respectively coupled with both ends of the body 210 to close left and right ends of the seventh chamber 280 and the eighth chamber 290. The caps 140 may be brazing-coupled with the second header 200. The caps 140 may have the same shape and perform the same function.

In the cover 220, a plurality of tube holes 124 in which the heat exchange tubes 10 are inserted may be formed. In the cover 220, a second connecting pipe hole 126 through which a refrigerant enters the second connecting pipe 600 may be formed.

The body 210 may include a tube stopper 116 for limiting an insertion depth of the heat exchange tubes 10. The tube stopper 116 may protrude from a lower outer surface of the wall 112, and prevent the heat exchange tubes 10 from being excessively inserted into insides of the fifth chamber 260 and the sixth chamber 270.

The fifth chamber 260 may be partitioned into a first sub chamber 261 and a second sub chamber 262 by a partition baffle 150 coupled with the second header 200 (see FIGS. 10 and 12). The sixth chamber 270 may be partitioned into a first sub chamber 271 and a second sub chamber 272 by the partition baffle 150 coupled with the second header 200 (see FIGS. 11 and 12). The partition baffle 150 may be inserted in a partition baffle hole 115 formed in the body 210 to be coupled with the second header 200. The partition baffle 150 may be brazing-coupled with the second header 200.

The heat exchange tubes 11 of the first column (rear column) may be connected to the first sub chamber 261 of the fifth chamber 260, and the second connecting pipe 600 may be connected to the second sub chamber 262 of the fifth chamber 260. The heat exchange tubes 12 of the second column (front column) may be connected to the first sub chamber 271 of the sixth chamber 270, and the outlet pipe 400 may be connected to the second sub chamber 272 of the sixth chamber 270.

The second connecting pipe 600 may connect the second sub chamber 262 of the fifth chamber 260 to the second sub chamber 272 of the second chamber 170. The first connecting pipe 500 may be in parallel to the heat exchange tubes 11 of the rear column (first column), the first chamber 160, and the third chamber 180. The second connecting pipe 600 may include a portion curved from a location being in parallel to the heat exchange tubes 11 of the rear column (first column), the fifth chamber 260, and the seventh chamber 280 to a location being in parallel to the heat exchange tubes 12 of the front column (second column), the second chamber 170, and the fourth chamber 190.

The body 210 may include at least one distribution hole 218 through which a refrigerant entered the first sub chamber 261 of the fifth chamber 260 flows to the seventh chamber 280. The body 210 may include a through hole 117 through which a refrigerant entered the seventh chamber 280 flows to the second sub chamber 262 of the fifth chamber 260.

The body 210 may include at least one distribution hole 219*a* and 219*b* through which a refrigerant entered the first sub chamber 271 of the sixth chamber 270 flows to the eighth chamber 290. The body 210 may include a through hole 117 through which a refrigerant entered the eighth chamber 290 enters the second sub chamber 272 of the sixth chamber 270.

Lengths of the through hole 117 and the distribution hole 218 in a longitudinal direction of the second header 200 may be longer than those of the through hole 117 and the distribution hole 218 in a width direction of the second header 200. In the eight chamber 290, a diameter of the distribution hole 219*a* being adjacent to the through hole 117 may be smaller than that of the distribution hole 219*b* being adjacent to the other side. One through hole 117 may be formed in each of the seventh chamber 280 and the eighth chamber 290, or, in the seventh chamber 280 and the eighth chamber 290, a plurality of distribution holes 218, 219*a*, and 219*b* may be formed at preset intervals.

In a flow of a refrigerant which will be described later, a refrigerant passing through the distribution holes 218, 219*a*, and 219*b* of the seventh chamber 280 and the eighth chamber 290 may be a liquid-phase refrigerant, and the distribution holes 218, 219*a*, and 219*b* having different sizes may be effective to distribute a liquid-phase refrigerant.

A refrigerant flowing from the heat exchange tubes 11 of the first column to the first sub chamber 261 of the fifth chamber 260 may equally flow to the inside space of the seventh chamber 280 through the distribution hole 218, and flow to the second sub chamber 262 of the fifth chamber 260 to be discharged to the second connecting pipe 600. A refrigerant flowing from the heat exchange tubes 12 of the second column to the first sub chamber 271 of the sixth chamber 270 may equally flow to the inside space of the eighth chamber 290 through the distribution holes 219*a* and 219*b*, and flow to the second sub chamber 272 of the sixth chamber 270 to be discharged to the outlet pipe 400.

As a result, a refrigerant entered the fifth chamber 260 through the heat exchange tubes 11 of the first column may be uniformly dispersed and discharged to the second connecting pipe 600, and a refrigerant entered the sixth chamber 270 through the heat exchange tubes 12 of the second column may be uniformly dispersed and discharged to the outlet pipe 400.

Also, refrigerants entered the seventh chamber 280 and the eighth chamber 290 may be mixed and stabilized in the seventh chamber 280 and the eighth chamber 290, before flowing to the second sub chamber 262 of the fifth chamber 260 and the second sub chamber 272 of the sixth chamber 270. Also, refrigerants entered the second sub chamber 262 of the fifth chamber 260 and the second sub chamber 272 of the sixth chamber 270 may be again mixed and stabilized in the second sub chamber 262 of the fifth chamber 260 and the second sub chamber 272 of the sixth chamber 270, before being discharged to the second connecting pipe 600 and the outlet pipe 400. Accordingly, circulation and heat exchange efficiency of refrigerants may increase.

Figure 11:
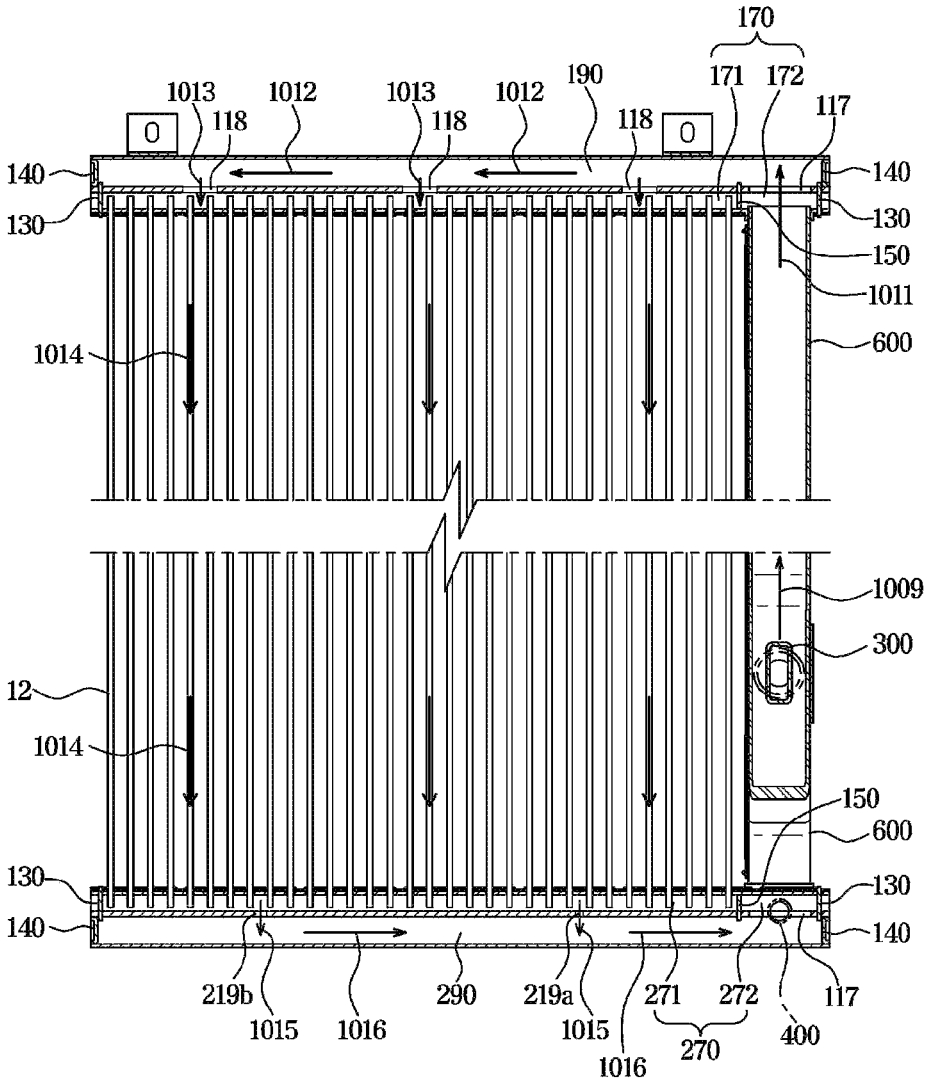
FIG. 11 is a front cross-sectional view illustrating flow of a refrigerant passing through tubes of a second column of the heat exchanger of FIG. 1.

FIG. 10 is a front cross-sectional view illustrating flow of a refrigerant passing through the tubes of the first column of the heat exchanger of FIG. 1, and FIG. 11 is a front cross-sectional view illustrating flow of a refrigerant passing through the tubes of the second column of the heat exchanger of FIG. 1. FIG. 12 is a side cross-sectional view illustrating flow of a refrigerant passing through the first connecting pipe and the second connecting pipe of the heat exchanger of FIG. 1.

Referring to FIGS. 10 to 12, a refrigerant may enter the first connecting pipe 500 through the inlet pipe 300 (1000). Because the second connecting pipe 600 is positioned in front of the first connecting pipe 500, the inlet pipe 300 may penetrate the second connecting pipe 600 to be connected to the first connecting pipe 500.

The refrigerant entered the first connecting pipe 500 may flow along the first connecting pipe 500 (1001), and then enter the third chamber 180 via the second sub chamber 162 of the first chamber 160 (1002). The refrigerant entered the third chamber 180 may flow along the third chamber 180 (1003) and be distributed to the first sub chamber 161 of the first chamber 160 through the distribution hole 118 (1004).

The refrigerant distributed to the first sub chamber 161 of the first chamber 160 may be equally distributed to the heat exchange tubes 11 of the first column. The refrigerant may exchange heat with outside air, while flowing along the heat exchange tubes 11 of the first column (1005), and then enter the first sub chamber 261 of the fifth chamber 260. The refrigerant entered the first sub chamber 261 of the fifth chamber 260 may enter the seventh chamber 280 through the distribution hole 218 (1006).

The refrigerant may flow along the seventh chamber 280 (1007) and enter the second connecting pipe 600 via the second sub chamber 262 of the fifth chamber 260 through the through hole 117 (1008). The refrigerant may flow along the second connecting pipe 600 (1009), and then enter the fourth chamber 190 via the second sub chamber 172 of the second chamber 170 (1011). The refrigerant entered the fourth chamber 190 may flow along the fourth chamber 190 (1012) and then be distributed to the first sub chamber 171 of the second chamber 170 through the distribution hole 118 (1013).

The refrigerant distributed to the first sub chamber 171 of the second chamber 170 may be equally distributed to the heat exchange tubes 12 of the second column. The refrigerant may exchange heat with outside air, while flowing along the heat exchange tubes 12 of the second column (1014), and then enter the first sub chamber 271 of the sixth chamber 270. The refrigerant entered the first sub chamber 271 of the sixth chamber 270 may enter the eighth chamber 290 through the distribution holes 219*a* and 219*b* (1015).

The refrigerant may flow along the eighth chamber 290 (1016), then enter the second sub chamber 272 of the sixth chamber 270 through the through hole 117, and be discharged to the outside of the heat exchanger 1 through the outlet pipe 400 connected to the second sub chamber 271 of the sixth chamber 270 (1017).

Figure 13:
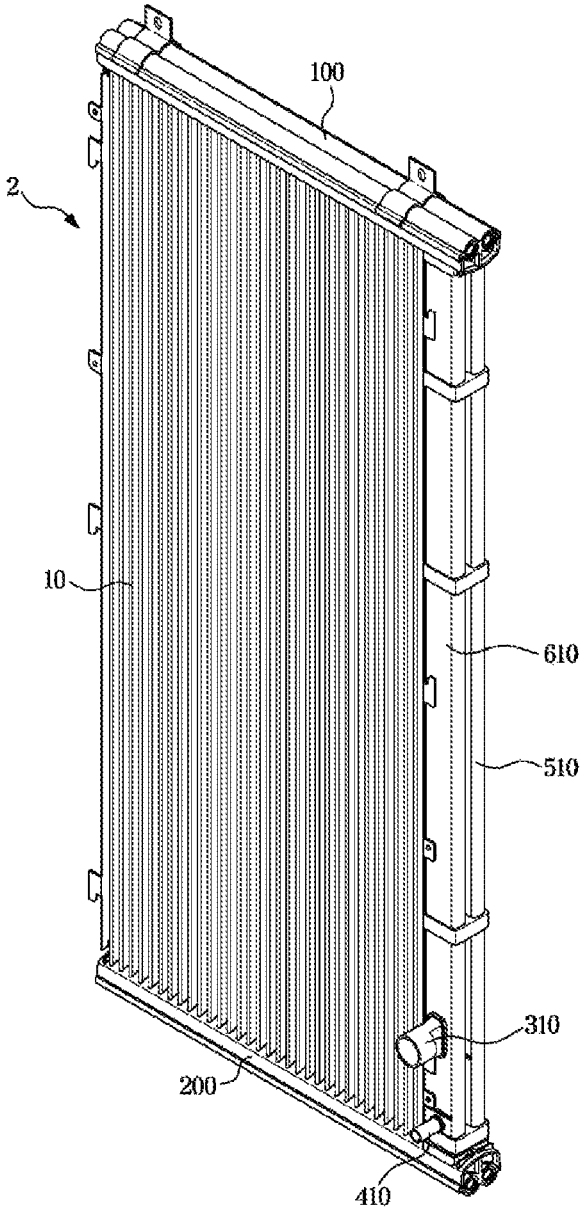
FIG. 13 is a perspective view illustrating an outer appearance of a heat exchanger according to an embodiment of the disclosure.
Figure 14:
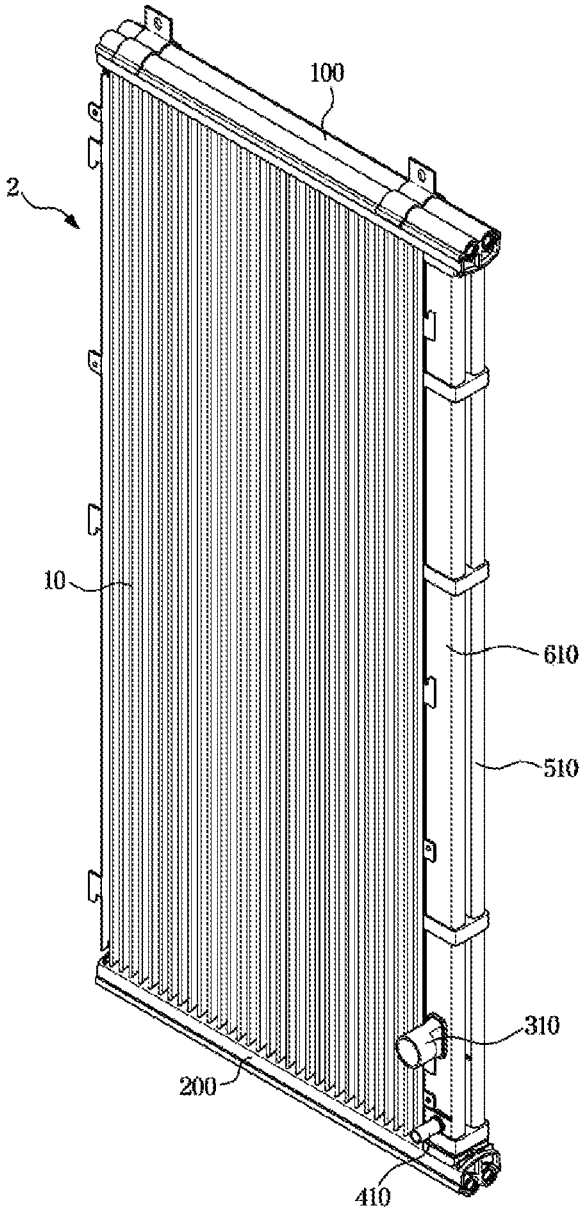
FIG. 14 is a side cross-sectional view illustrating flow of a refrigerant passing through a first connecting pipe and a second connecting pipe of the heat exchanger of FIG. 13.

FIG. 13 is a perspective view illustrating an outer appearance of a heat exchanger according to an embodiment of the disclosure, and FIG. 14 is a side cross-sectional view illustrating flow of a refrigerant passing through a first connecting pipe and a second connecting pipe of the heat exchanger of FIG. 13.

In a heat exchanger 2 illustrated in FIG. 13, a plurality of heat exchange tubes 10, a first header 100, and a second header 200 may have the same configurations as the corresponding ones of the heat exchanger 1 illustrated in FIG. 1.

Accordingly, descriptions about the heat exchange tubes 10, the first header 100, and the second header 200 will be omitted.

Referring to FIGS. 13 and 14, the heat exchanger 2 according to an embodiment of the disclosure may include an inlet pipe 310 through which an external refrigerant enters upon driving of a heating cycle and a refrigerant is discharged to outside upon driving of a cooling cycle, an outlet pipe 410 through which a refrigerant is discharged to the outsides upon driving of a heating cycle and an external refrigerant enters upon driving of a cooling cycle, and a first connecting pipe 510 and a second connecting pipe 610 connecting the first header 100 to the second header 200.

One inlet pipe 310, one outlet pipe 410, one first connecting pipe 510, and one second connecting pipe 610 may be provided. A refrigerant may enter the first connecting pipe 510 and be supplied to the first header 100 through the inlet pipe 310, and a refrigerant may be discharged from the second header 200 to the outside through the outlet pipe 410. Also, a refrigerant may flow from the second header 200 to the second header 100 via the first connecting pipe 510, the second connecting pipe 610, and a third connecting pipe 710, without passing through the heat exchange tubes 10.

The first header 100, the second header 200, the first connecting pipe 510, and the second connecting pipe 610 may be coupled into one body by brazing. For brazing-coupling, at least one of the first header 100, the second header 200, the first connecting pipe 510, and the second connecting pipe 610 may include a clad material.

The first connecting pipe 510 may be positioned behind the second connecting pipe 610. The inlet pipe 310 may penetrate the second connecting pipe 610 to be connected to the first connecting pipe 510. The inlet pipe 310 and the outlet pipe 410 may protrude from the same side (front or rear side) of the heat exchanger 2. Because the inlet pipe 310 and the outlet pipe 410 protrude from the same side, it may be possible to easily perform brazing coupling after stably laying the heat exchanger 2 on the floor.

A diameter of the inlet pipe 310 may be larger than that of the outlet pipe 410. A high-temperature and high-pressure gas-phase refrigerant passed through a compressor (not shown) may enter the inlet pipe 310. The refrigerant entered the inlet pipe 310 may pass through the heat exchange tubes 10 to lose heat from outside and be condensed, and the condensed refrigerant may be discharged to the outside through the outlet pipe 410. Accordingly, in such a heating cycle, the heat exchanger 2 may function as a condenser.

In contrast, a low-temperature and low-pressure liquid-phase or gas-phase refrigerant passed through an expansion valve (not shown) may enter through the outlet pipe 410, and pass through the heat exchange tubes 10 to take away heat from outside and be evaporated. The evaporated refrigerant may be discharged to the outside through the inlet pipe 310. Accordingly, in such a cooling cycle, the heat exchanger 2 may function as an evaporator.

Hereinafter, a case in which the heat exchanger 2 according to an embodiment of the disclosure is used as a condenser will be mainly described. However, in the case in which a refrigerant circulates in the reverse cycle described above, the heat exchanger 2 may be used as an evaporator.

The heat exchange tubes 11 of the first column may be connected to the first chamber 160, and the heat exchange tubes 12 of the second column may be connected to the second chamber 170. The first chamber 160 may be connected to the first connecting pipe 510, and the second chamber 170 may be connected to the second connecting pipe 610. A refrigerant entered through the inlet pipe 310 and the first connecting pipe 510 may be supplied to the first chamber 160, and a refrigerant may also enter the second chamber 170 through the second connecting pipe 610.

The heat exchange tubes 11 of the first column (rear column) may be connected to the first sub chamber 161 of the first chamber 160, and the first connecting pipe 510 may be connected to the second sub chamber 162 of the first chamber 160. The heat exchange tubes 12 of the second column (front column) may be connected to the first sub chamber 171 of the second chamber 170, and the second connecting pipe 610 may be connected to the second sub chamber 172 of the second chamber 170.

The fifth chamber 260 may be connected to the heat exchange tubes 11 of the first column, and the sixth chamber 270 may be connected to the heat exchange tubes 12 of the second column. The fifth chamber 260 may be connected to the first connecting pipe 510, and the sixth chamber 270 may be connected to the second connecting pipe 610. The second connecting pipe 610 may be connected to the outlet pipe 410.

The first sub chamber 261 of the fifth chamber 260 may be connected to the heat exchange tubes 11 of the first column (rear column), and the second sub chamber 262 of the fifth chamber 260 may be connected to the first connecting pipe 510. The first sub chamber 271 of the sixth chamber 270 may be connected to the heat exchange tubes 12 of the second column, and the second sub chamber 272 of the sixth chamber 270 may be connected to the second connecting pipe 610.

The first connecting pipe 510 and the second connecting pipe 610 may be straight pipes having a section of a rectangular shape. The first connecting pipe 510 and the second connecting pipe 610 may be connected to the first header 100 and the second header 200 at both ends.

The first connecting pipe 510 may connect the second sub chamber 262 of the fifth chamber 260 to the second sub chamber 162 of the first chamber 160. The second connecting pipe 610 may connect the second sub chamber 272 of the sixth chamber 270 to the second sub chamber 272 of the second chamber 170. The first connecting pipe 510 may be in parallel to the heat exchange tubes 11 of the rear column (first column), the first chamber 160, and the third chamber 180. The second connecting pipe 610 may be in parallel to the heat exchange tubes 12 of the front column (second column), the second chamber 170, and the fourth chamber 190.

The heat exchanger 2 may further include the third connecting pipe 710 connecting the first connecting pipe 510 to the second connecting pipe 610. The first connecting pipe 510 may include a partition baffle 513 for partitioning a first space 511 communicating with the inlet pipe 310 from a second space 512 communicating with the third connecting pipe 710. The first space 511 may be formed at a portion of the first connecting pipe 510 toward the first header 100, and the second space 512 may be formed at a portion of the first connecting pipe 510 toward the second header 200.

The second connecting pipe 610 may include a partition baffle 613 for partitioning a first space 611 communicating with the third connecting pipe 710 from a second space 612 communicating with the outlet pipe 410. The first space 611 may be formed at a portion of the second connecting pipe 610 toward the first header 100, and the second space 612 may be formed at a portion of the second connecting pipe 610 toward the second header 200.

A refrigerant may enter the first connecting pipe 510 through the inlet pipe 310 (1000). Because the second connecting pipe 610 is positioned in front of the first connecting pipe 510, the inlet pipe 310 may penetrate the second connecting pipe 610 to be connected to the first connecting pipe 510.

The refrigerant entered the first connecting pipe 510 may flow along the first space 511 of the first connecting pipe 510 (1001), and then enter the first header 100. Then, the refrigerant may escape from the first header 100 and flow along the heat exchange tubes 11 of the first column. The refrigerant may exchange heat with outside air, while flowing along the heat exchange tubes 11 of the first column, and then enter the second header 200.

The refrigerant flowing along the seventh chamber 280 may enter the first connecting pipe 510 via the second sub chamber 262 of the fifth chamber 260 through the through hole 117 (1108). The refrigerant may flow along the second space 512 of the first connecting pipe 510, and enter the second connecting pipe 610 through the third connecting pipe 710. The refrigerant may flow along the first space 611 of the second connecting pipe 610 (1109), and then enter the first header 100. The refrigerant may escape from the first header 100, and flow along the heat exchange tubes 12 of the second column. The refrigerant may exchange heat with outside air, while flowing along the heat exchange tubes 12 of the second column, and then enter the second header 200.

The refrigerant flowing along the eighth chamber 290 may enter the second connecting pipe 610 via the second sub chamber 272 of the sixth chamber 270 through the through hole 117 (1117). The refrigerant may flow along the second space 612 of the second connecting pipe 610, and then be discharged to the outside of the heat exchanger 2 through the outlet pipe 410 connected to the second connecting pipe 610 (1118).

Figure 15:
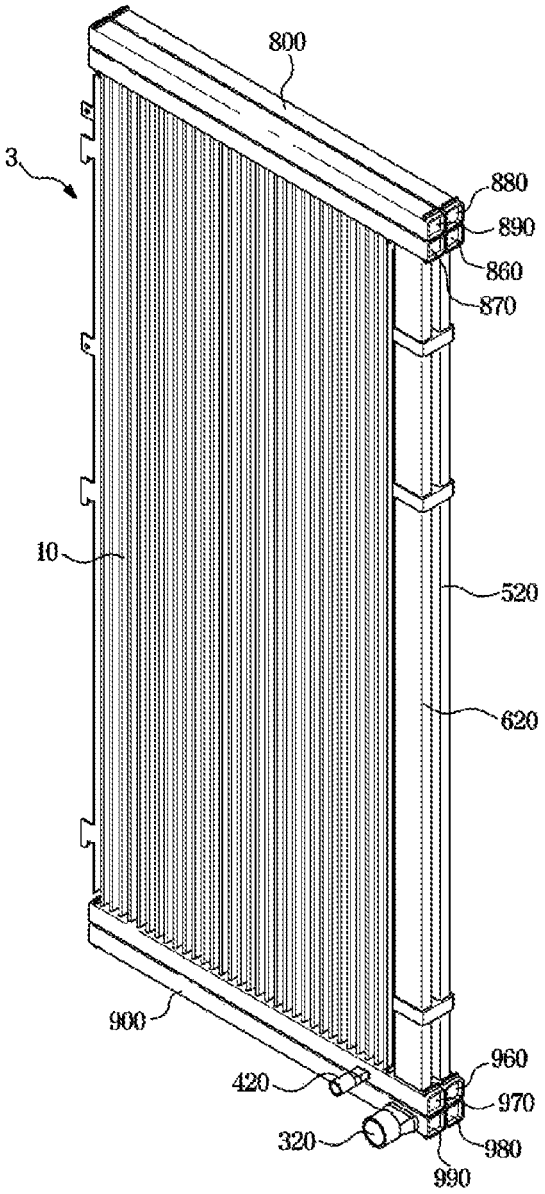
FIG. 15 is a perspective view illustrating an outer appearance of a heat exchanger according to an embodiment of the disclosure.
Figure 16:
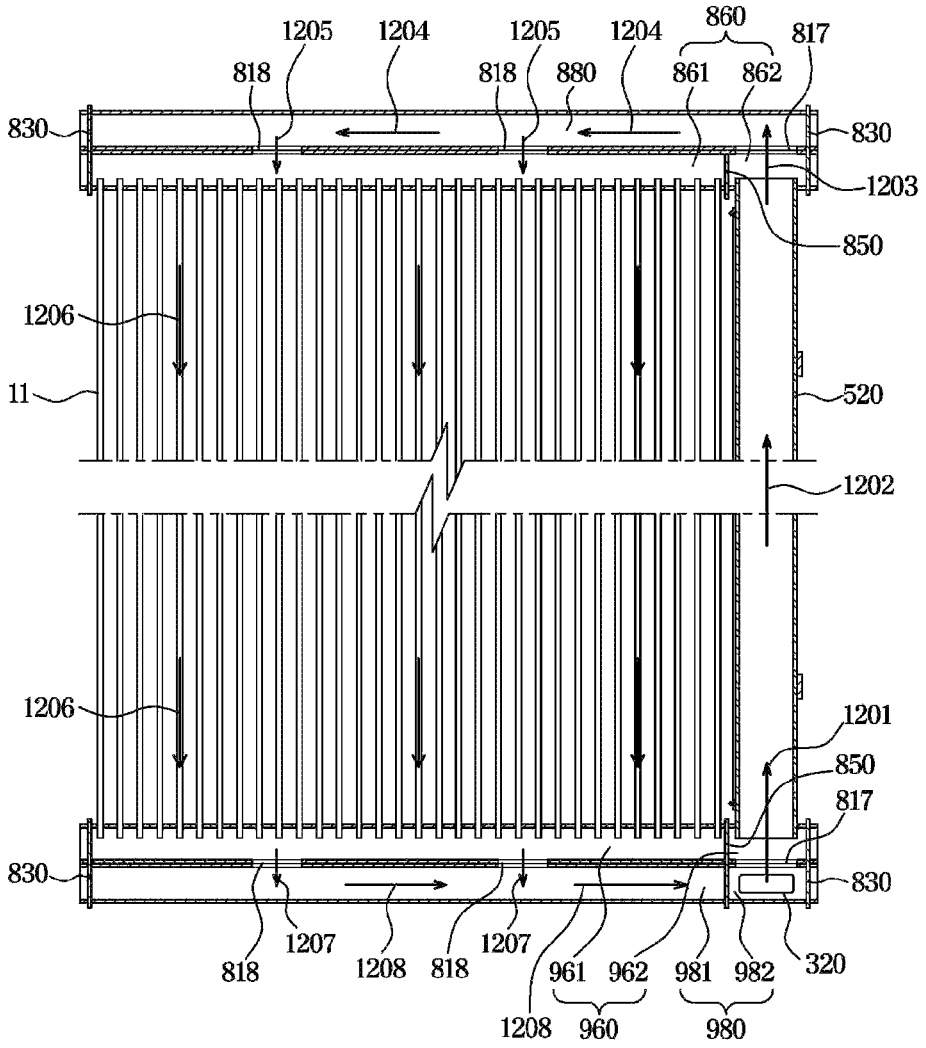
FIG. 16 is a front cross-sectional view illustrating flow of a refrigerant passing through tubes of a first column of the heat exchanger of FIG. 15.
Figure 17:
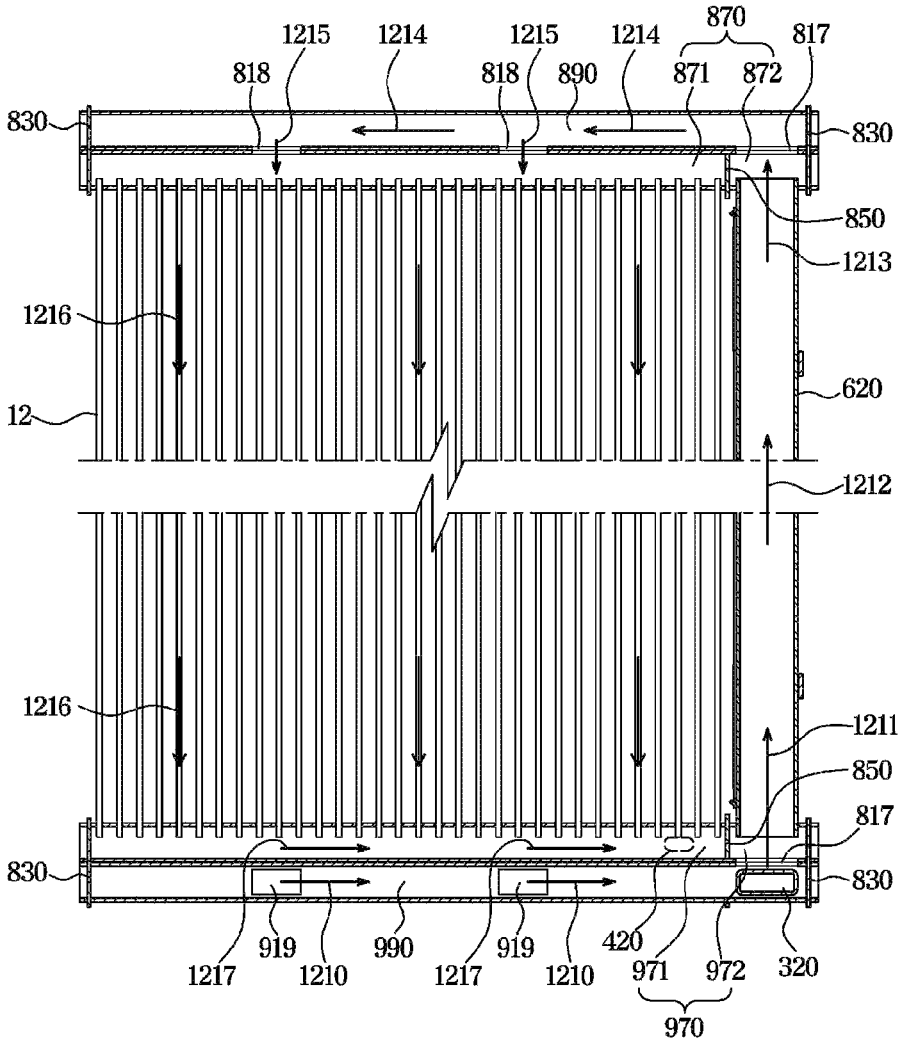
FIG. 17 is a front cross-sectional view illustrating flow of a refrigerant passing through tubes of a second column of the heat exchanger of FIG. 15.
Figure 18:
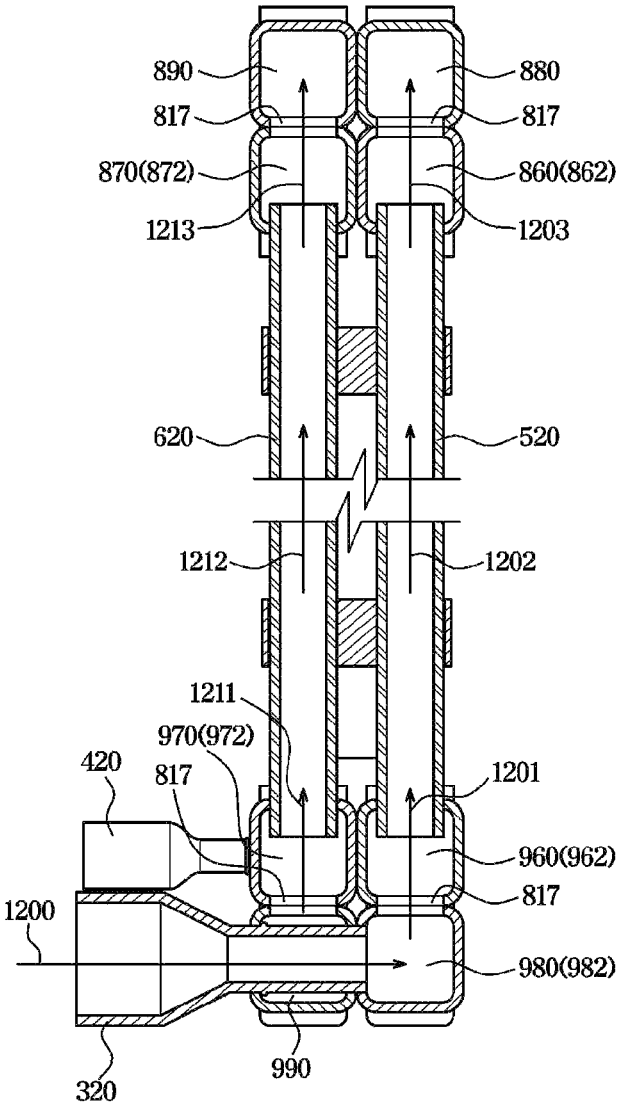
FIG. 18 is a side cross-sectional view illustrating flow of a refrigerant passing through a first connecting pipe and a second connecting pipe of the heat exchanger of FIG. 15.
Figure 19:
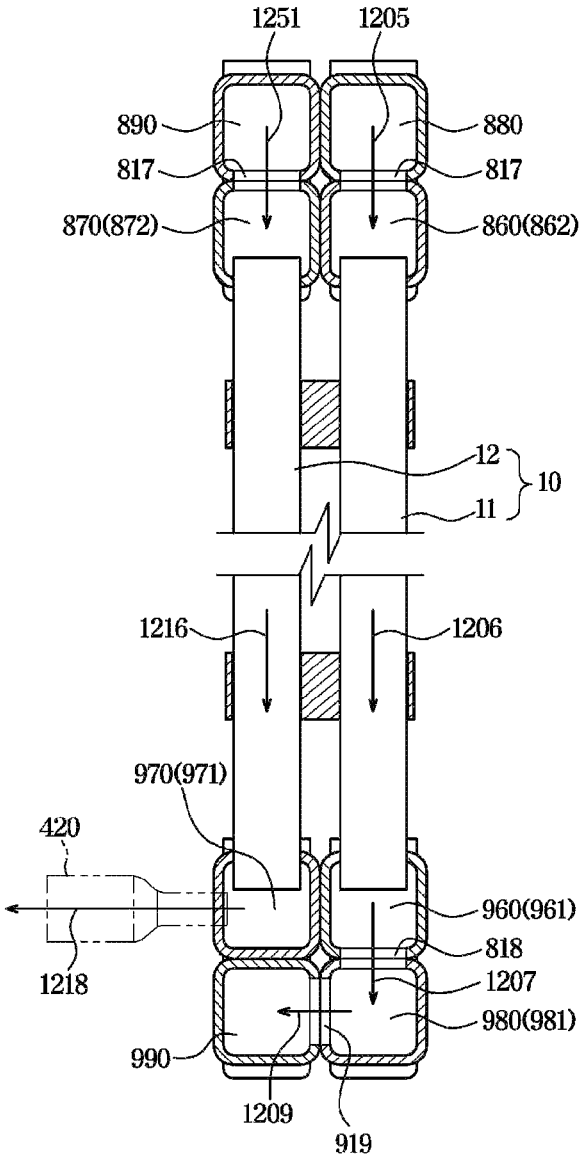
FIG. 19 is a side cross-sectional view illustrating flow of a refrigerant passing through the tubes of the first column and the tubes of the second column of the heat exchanger of FIG. 15.

FIG. 15 is a perspective view illustrating an outer appearance of a heat exchanger according to an embodiment of the disclosure. FIG. 16 is a front cross-sectional view illustrating flow of a refrigerant passing through tubes of a first column of the heat exchanger of FIG. 15, and FIG. 17 is a front cross-sectional view illustrating flow of a refrigerant passing through tubes of a second column of the heat exchanger of FIG. 15. FIG. 18 is a side cross-sectional view illustrating flow of a refrigerant passing through a first connecting pipe and a second connecting pipe of the heat exchanger of FIG. 15, and FIG. 19 is a side cross-sectional view illustrating flow of a refrigerant passing through the tubes of the first column and the tubes of the second column of the heat exchanger of FIG. 15.

In a heat exchanger 3 illustrated in FIG. 15, heat exchange tubes 10 may have the same configuration as the heat exchange tubes 10 of the heat exchanger 1 illustrated in FIG. 1. Accordingly, descriptions about the heat exchange tubes 10 will be omitted.

Referring to FIGS. 15 to 19, the heat exchanger 3 according to an embodiment of the disclosure may include the plurality of heat exchange tubes 10 along which a refrigerant flows to exchange heat with outside air, a first header 800 and a second header 900 with which the plurality of heat exchange tubes 10 communicate, an inlet pipe 320 through which an external refrigerant enters upon driving of a heating cycle and a refrigerant is discharged to outside upon driving of a cooling cycle, an outlet pipe 420 through which a refrigerant is discharged to the outside upon driving of a heating cycle and an external refrigerant enters upon driving of a cooling cycle, and a first connecting pipe 520 and a second connecting pipe 620 connecting the first header 800 to the second header 900.

The first header 800 may be spaced a preset distance from the second header 900, and the heat exchange tubes 10 may be positioned between the first header 800 and the second header 900. The first header 800 may be positioned at upper ends of the heat exchange tubes 10, and the second header 900 may be positioned at lower ends of the heat exchange tubes 10.

One inlet pipe 320, one outlet pipe 420, one first connecting pipe 520, and one second connecting pipe 620 may be provided. A refrigerant may enter the first connecting pipe 520 through the inlet pipe 320 to be supplied to the first header 800, and a refrigerant may be discharged to outside from the second header 900 through the outlet pipe 420. Also, a refrigerant may flow from the second header 900 to the first header 800 through the second connecting pipe 620 without passing through the heat exchange tubes 10.

The first header 800, the second header 900, the first connecting pipe 520, and the second connecting pipe 620 may be coupled into one body by brazing. For brazing coupling, at least one of the first header 800, the second header 900, the first connecting pipe 520, and the second connecting pipe 620 may include a clad material.

The inlet pipe 320 and the outlet pipe 420 may protrude from the same side (front or rear side) of the heat exchanger 3. Because the inlet pipe 320 and the outlet pipe 420 protrude from the same side, it may be possible to easily perform brazing coupling after stably laying the heat exchanger 3 on the floor.

A diameter of the inlet pipe 320 may be larger than that of the outlet pipe 420. A high-temperature and high-pressure gas-phase refrigerant passed through a compressor (not shown) may enter the inlet pipe 320. The refrigerant entered the inlet pipe 320 may pass through the heat exchange tubes 10 to lose heat from outside and be condensed, and the condensed refrigerant may be discharged to the outside through the outlet pipe 420. Accordingly, in such a heating cycle, the heat exchanger 3 may function as a condenser.

In contrast, a low-temperature and low-pressure liquid-phase or gas-phase refrigerant passed through an expansion valve (not shown) may enter through the outlet pipe 420, and pass through the heat exchange tubes 10 to take away heat from outside and be evaporated. The evaporated refrigerant may be discharged to the outside through the inlet pipe 320. Accordingly, in such a cooling cycle, the heat exchanger 3 may function as an evaporator.

Hereinafter, a case in which the heat exchanger 3 according to an embodiment of the disclosure is used as a condenser will be mainly described. However, in the case in which a refrigerant circulates in the reverse cycle described above, the heat exchanger 3 may be used as an evaporator.

The first header 800 may include a plurality of chambers 860, 870, 880, and 890 through which a refrigerant flows. The first header 800 may be configured with four electric resistance welded pipes of which each forms a chamber and which are basically isolated from each other. The electric resistance welded pipes may be brazing-coupled with each other. The first header 800 may include a first chamber 860, a second chamber 870, a third chamber 880, and a fourth chamber 890.

The first chamber 860 may be connected to the heat exchange tubes 11 of the first column, and the second chamber 870 may be connected to the heat exchange tubes 12 of the second column. The first chamber 860 may be connected to the first connecting pipe 520, and the second chamber 870 may be connected to the second connecting pipe 620. A refrigerant entered through the inlet pipe 320 and the first connecting pipe 520 may be supplied to the first chamber 860, and a refrigerant may enter the second chamber 870 through the second connecting pipe 620.

A plurality of cover baffles 830 may be respectively coupled with both ends of the first header 800 to close left and right ends of the first chamber 860, the second chamber 870, the third chamber 880, and the fourth chamber 890. The cover baffles 830 may be brazing-coupled with the first header 800. The cover baffles 830 may have the same shape and perform the same function.

The first chamber 860 may be partitioned into a first sub chamber 861 and a second sub chamber 862 by a partition baffle 850 coupled with the first header 800. The second chamber 870 may be partitioned into a first sub chamber 871 and a second sub chamber 872 by the partition baffle 850 coupled with the first header 800. The partition baffle 850 may be brazing-coupled with the first header 800.

The first sub chamber 861 of the first chamber 860 may be connected to the heat exchange tubes 11 of the first column (rear column), and the second sub chamber 862 of the first chamber 860 may be connected to the first connecting pipe 520. The first sub chamber 871 of the second chamber 870 may be connected to the heat exchange tubes 12 of the second column (front column), and the second sub chamber 872 of the second chamber 870 may be connected to the second connecting pipe 620.

The first header 800 may include a through hole 817 through which a refrigerant entered the second sub chamber 862 of the first chamber 860 flows to the third chamber 880. The first header 800 may include at least one distribution hole 818 through which a refrigerant entered the third chamber 880 enters the first sub chamber 861 of the first chamber 860.

The first header 800 may include a through hole 817 through which a refrigerant entered the second sub chamber 872 of the second chamber 870 flows to the fourth chamber 890. The first header 800 may include at least one distribution hole 818 through which a refrigerant entered the fourth chamber 890 enters the first sub chamber 871 of the second chamber 870.

Lengths of the through hole 817 and the distribution hole 818 in a longitudinal direction of the first header 800 may be longer than those of the through hole 817 and the distribution hole 818 in a width direction of the first header 800. One through hole 817 may be formed in each of the chambers 860, 870, 880, and 890, and a plurality of distribution holes 818 may be formed at preset intervals in each of the chambers 860, 870, 880, and 890.

The refrigerant entered the third chamber 880 may flow to the first sub chamber 861 of the first chamber 860 through the distribution hole 818, and may be equally distributed to the heat exchange tubes 11 of the first column. The refrigerant entered the fourth chamber 890 may flow to the first sub chamber 871 of the second chamber 870 through the distribution hole 818, and may be equally distributed to the heat exchange tubes 12 of the second column.

As a result, a refrigerant entered the first chamber 860 through the first connecting pipe 520 may be uniformly dispersed and distributed to the heat exchange tubes 11 of the first column, and a refrigerant entered the second chamber 870 through the second connecting pipe 620 may be uniformly dispersed and distributed to the heat exchange tubes 12 of the second column.

Also, refrigerants entered the second sub chamber 862 of the first chamber 860 and the second sub chamber 872 of the second chamber 870 may be mixed and stabilized in the second sub chamber 862 of the first chamber 860 and the second sub chamber 872 of the second chamber 870, before flowing to inside spaces of the third chamber 880 and the fourth chamber 890. Accordingly, distribution and heat exchange efficiency of refrigerants may increase.

The second header 900 may include a plurality of chambers 960, 970, 980, and 990 along which a refrigerant flows. The second header 900 may be configured with four electric resistance welded pipes of which each forms a chamber and which are basically isolated from each other. The electric resistance welded pipes may be brazing-coupled with each other. The second header 900 may include a fifth chamber 960, a sixth chamber 970, a seventh chamber 980, and an eighth chamber 990.

The fifth chamber 960 may be connected to the heat exchange tubes 11 of the first column, and the sixth chamber 970 may be connected to the heat exchange tubes 12 of the second column. The fifth chamber 960 may be connected to the first connecting pipe 520, and the sixth chamber 970 may be connected to the second connecting pipe 620. The inlet pipe 320 may penetrate the eighth chamber 990 to be connected to the seventh chamber 980. The outlet pipe 420 may be connected to the sixth chamber 970.

A plurality of cover baffles 830 may be respectively coupled with both ends of the second header 900 to close left and right ends of the fifth chamber 960, the sixth chamber 970, the seventh chamber 980, and the eighth chamber 990. The cover baffles 830 may be brazing-coupled with the second header 900. The cover baffles 830 may have the same shape and perform the same function.

The fifth chamber 960 may be partitioned into a first sub chamber 961 and a second sub chamber 962 by a partition baffle 850 coupled with the second header 900. The sixth chamber 970 may be partitioned into a first sub chamber 971 and a second sub chamber 972 by the partition baffle 850 coupled with the second header 900. The seventh chamber 980 may be partitioned into a first sub chamber 981 and a second sub chamber 982 by the partition baffle 850 coupled with the second header 900. The partition baffle 850 may be brazing-coupled with the second header 900.

The first sub chamber 961 of the fifth chamber 960 may be connected to the heat exchange tubes 11 of the first column (rear column), and the second sub chamber 962 of the fifth chamber 960 may be connected to the first connecting pipe 520. The first sub chamber 971 of the sixth chamber 970 may be connected to the heat exchange tubes 12 of the second column (front column, and the second sub chamber 972 of the sixth chamber 970 may be connected to the second connecting pipe 620.

The first connecting pipe 520 and the second connecting pipe 620 may be straight pipes having a section of a rectangular shape. The first connecting pipe 520 and the second connecting pipe 620 may be connected to the first header 800 and the second header 900 at both ends.

The first connecting pipe 520 may connect the second sub chamber 962 of the fifth chamber 960 to the second sub chamber 862 of the first chamber 860. The second connecting pipe 620 may connect the second sub chamber 972 of the sixth chamber 970 to the second sub chamber 872 of the second chamber 870. The first connecting pipe 520 may be in parallel to the heat exchange tubes 11 of the rear column (first column), the first chamber 860, and the third chamber 880. The second connecting pipe 620 may be in parallel to the heat exchange tubes 12 of the front column (second column), the second chamber 870, and the fourth chamber 890.

The inlet pipe 320 may penetrate the eighth chamber 990 to be connected to the second sub chamber 982 of the seventh chamber 980. The second header 900 may include a through hole 817 through which a refrigerant entered the second sub chamber 982 of the seventh chamber 980 enters the second sub chamber 962 of the fifth chamber 960.

The second header 900 may include at least one distribution hole 818 through which a refrigerant entered the first sub chamber 961 of the fifth chamber 960 flows to the first sub chamber 981 of the seventh chamber 980. The second header 900 may include at least one distribution hole 919 through which the refrigerant entered the first sub chamber 981 of the seventh chamber 980 flows to the eighth chamber 990.

The second header 900 may include a through hole 817 through which the refrigerant entered the eighth chamber 990 enters the second sub chamber 972 of the sixth chamber 970. The outlet pipe 420 may be connected to the first sub chamber 971 of the sixth chamber 970.

Lengths of the through hole 817 and the distribution hole 818 in a longitudinal direction of the second header 900 may be longer than those of the through hole 817 and the distribution hole 818 in a width direction of the second header 900. One through hole 817 may be formed in each of the seventh chamber 980 and the eighth chamber 990, and a plurality of distribution holes 818 may be formed at preset intervals in each of the seventh chamber 980 and the eighth chamber 990. In a flow of a refrigerant which will be described later, a refrigerant passing through the distribution holes 818 of the seventh chamber 980 and the eighth chamber 990 may be a liquid-phase refrigerant.

A refrigerant flowing from the heat exchange tubes 11 of the first column to the first sub chamber 961 of the fifth chamber 960 may equally flow to the inside space of the seventh chamber 980 through the distribution hole 818. The refrigerant entered the seventh chamber 980 may flow to the eighth chamber 990 through the distribution hole 919 to be discharged to the second connecting pipe 620 through the through hole 817 and the second sub chamber 972 of the sixth chamber 970.

A refrigerant entered the first sub chamber 971 of the sixth chamber 970 from the heat exchange tubes 12 of the second column may be discharged to the outlet pipe 420 connected to the first sub chamber 971 of the sixth chamber 970.

As a result, a refrigerant entered the fifth chamber 960 through the heat exchange tubes 11 of the first column may be uniformly dispersed and discharged to the second connecting pipe 620, and a refrigerant entered the sixth chamber 970 through the heat exchange tubes 12 of the second column may be uniformly dispersed and discharged to the outlet pipe 420.

Also, refrigerants entered the seventh chamber 980 and the eighth chamber 990 may be mixed and stabilized in the seventh chamber 980 and the eighth chamber 990, before flowing to the second sub chamber 972 of the sixth chamber 970. Also, refrigerants entered the second sub chamber 962 of the fifth chamber 960 and the second sub chamber 972 of the sixth chamber 970 may be again mixed and stabilized in the second sub chamber 962 of the fifth chamber 960 and the second sub chamber 972 of the sixth chamber 970, before being discharged to the first connecting pipe 520 and the second connecting pipe 620. Accordingly, distribution and heat exchange efficiency of refrigerants may increase.

A refrigerant may enter the second sub chamber 972 of the seventh chamber 980 through the inlet pipe 320 (1200). Because the eighth chamber 990 is positioned in front of the seventh chamber 980, the inlet pipe 320 may penetrate the eighth chamber 990 to be connected to the second sub chamber 972 of the seventh chamber 980.

The refrigerant entered the second sub chamber 972 of the seventh chamber 980 may enter the first connecting pipe 520 via the second sub chamber 962 of the fifth chamber 960 (1201). The refrigerant entered the first connecting pipe 520 may flow along the first connecting pipe 520 and then enter the third chamber 880 via the second sub chamber 862 of the first chamber 860 (1203). The refrigerant entered the third chamber 880 may flow along the third chamber 880 (1204) to be distributed to the first sub chamber 861 of the first chamber 860 through the distribution hole 818 (1205).

The refrigerant distributed to the first sub chamber 861 of the first chamber 860 may be equally distributed to the heat exchange tubes 11 of the first column. The refrigerant may exchange heat with outside air, while flowing along the heat exchange tubes 11 of the first column (1206), and then enter the first sub chamber 961 of the fifth chamber 960. The refrigerant entered the first sub chamber 961 of the fifth chamber 960 may enter the first sub chamber 981 of the seventh chamber 980 through the distribution hole 818 (1207).

The refrigerant entered the first sub chamber 981 of the seventh chamber 980 may enter the eighth chamber 990 through the distribution hole 919 (1209). The refrigerant may flow along the eighth chamber 990 (1210), and then enter the second connecting pipe 620 via the second sub chamber 972 of the sixth chamber 970 through the through hole 817 (1211). The refrigerant may flow along the second connecting pipe 620 (1212) and then enter the fourth chamber 890 via the second sub chamber 872 of the second chamber 870 (1213). The refrigerant entered the fourth chamber 890 may flow along the fourth chamber 890 (1214) and then be distributed to the first sub chamber 871 of the second chamber 870 through the distribution hole 818 (1215).

The refrigerant distributed to the first sub chamber 871 of the second chamber 870 may be equally distributed to the heat exchange tubes 12 of the second column. The refrigerant may exchange heat with outside air, while flowing along the inside of the heat exchange tubes 12 of the second column (1216), and then enter the first sub chamber 971 of the sixth chamber 970. The refrigerant may flow along the first sub chamber 971 of the sixth chamber 970 (1217) and then be discharged to the outside of the heat exchanger 3 through the outlet pipe 420 connected to the first sub chamber 971 of the sixth chamber 970 (1218).

Figure 20:
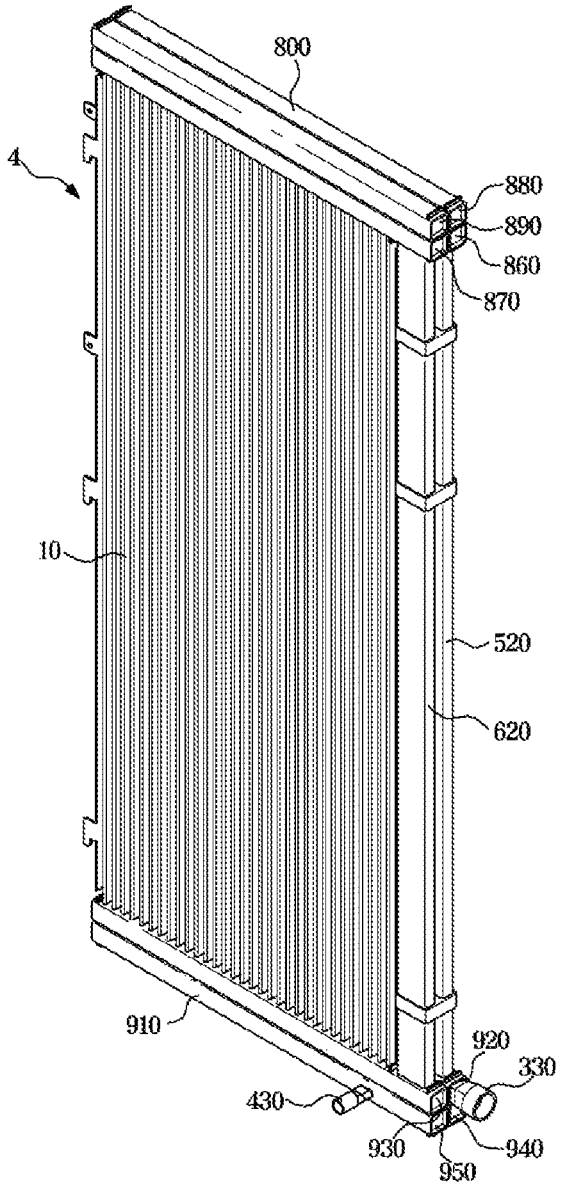
FIG. 20 is a perspective view illustrating an outer appearance of a heat exchanger according to an embodiment of the disclosure.
Figure 21:
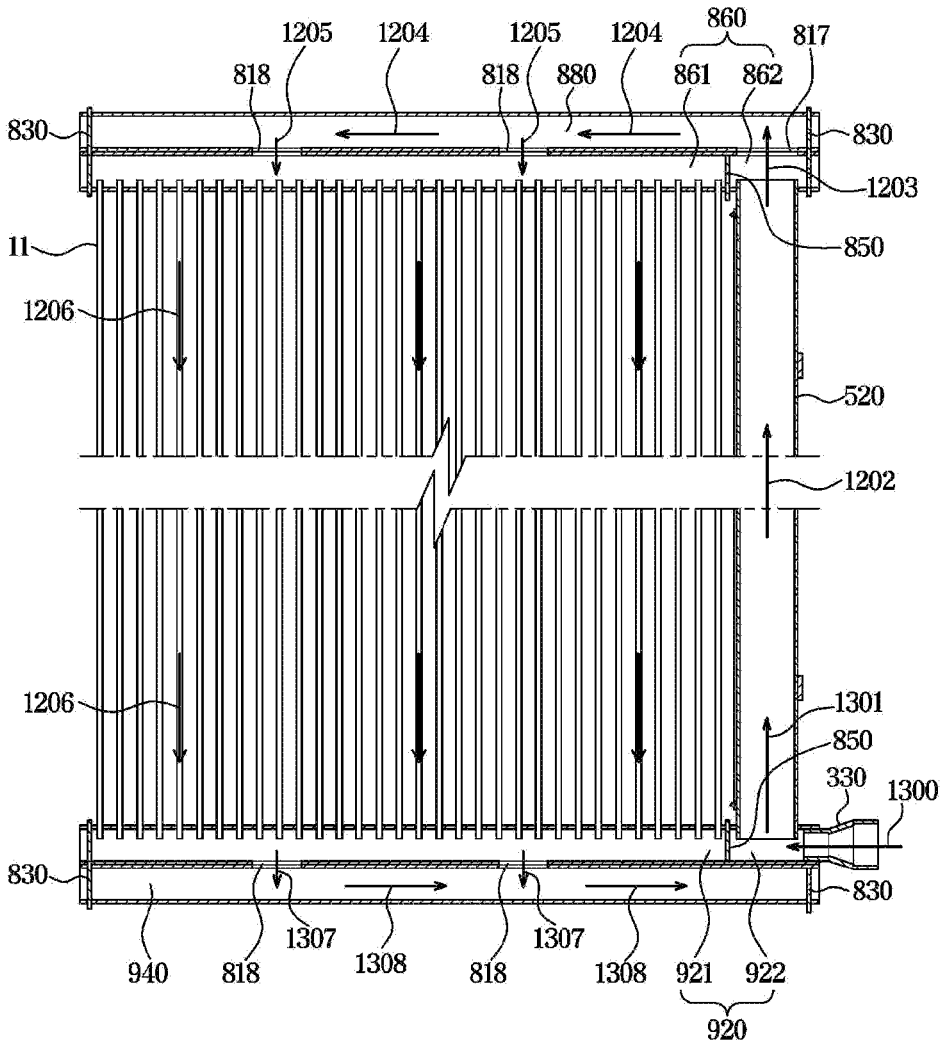
FIG. 21 is a front cross-sectional view illustrating flow of a refrigerant passing through tubes of a first column of the heat exchanger of FIG. 20.
Figure 22:
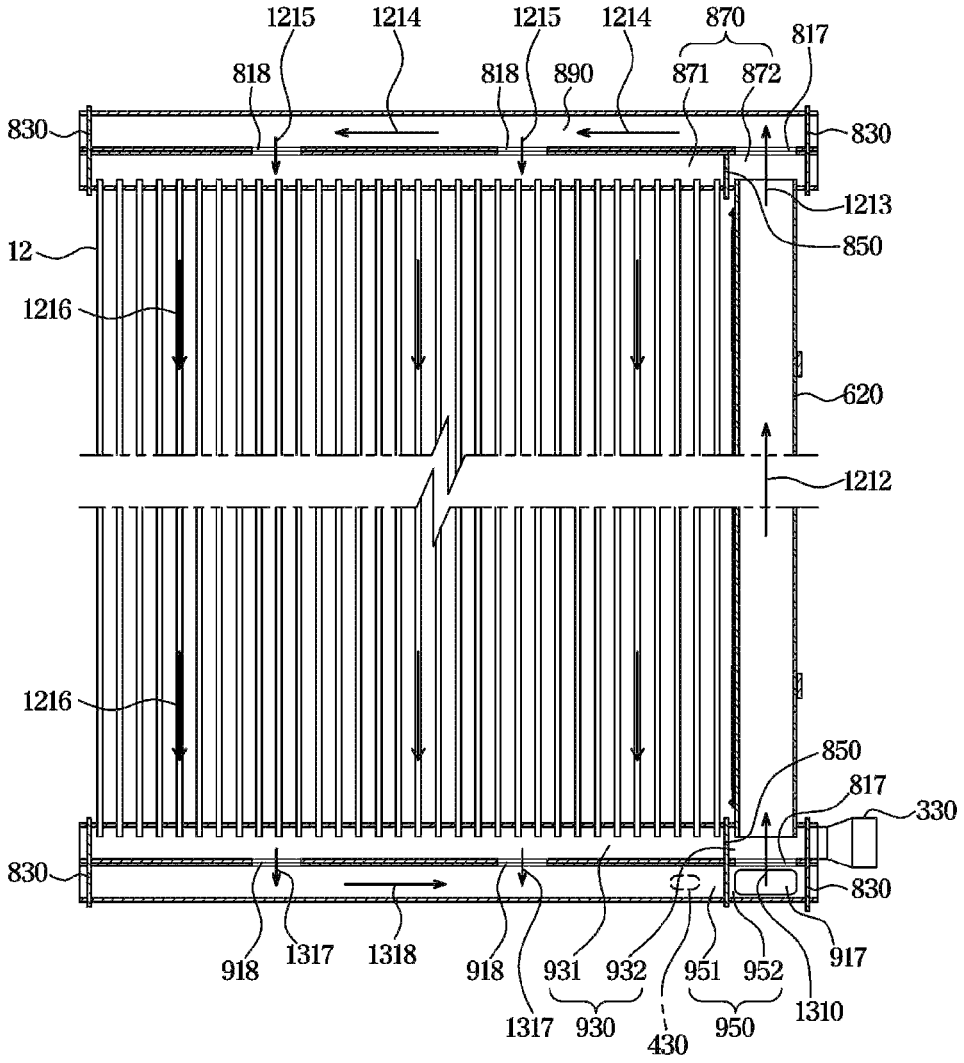
FIG. 22 is a front cross-sectional view illustrating flow of a refrigerant passing through tubes of a second column of the heat exchanger of FIG. 20.
Figure 23:
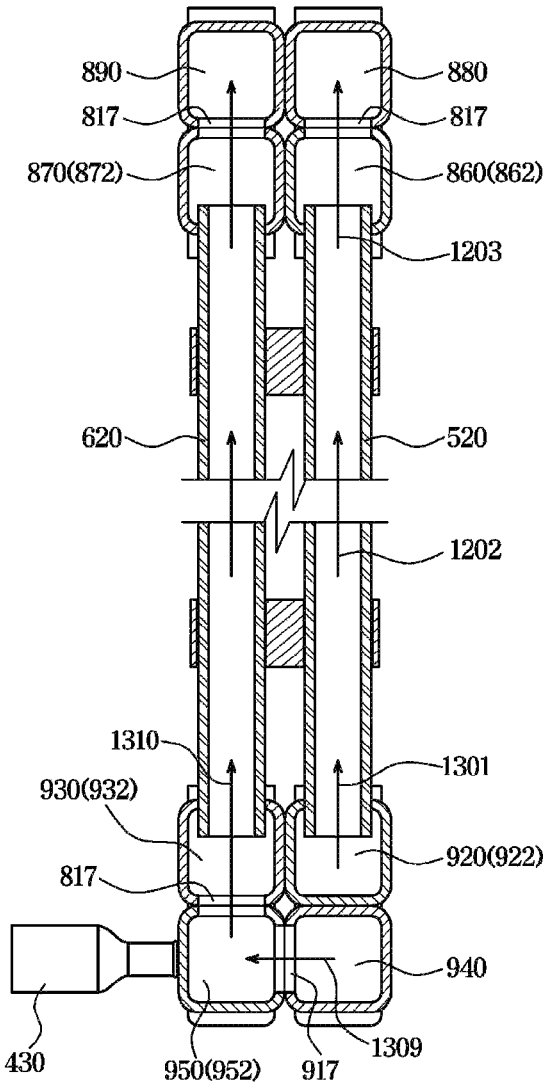
FIG. 23 is a side cross-sectional view illustrating flow of a refrigerant passing through a first connecting pipe and a second connecting pipe of the heat exchanger of FIG. 20.
Figure 24:
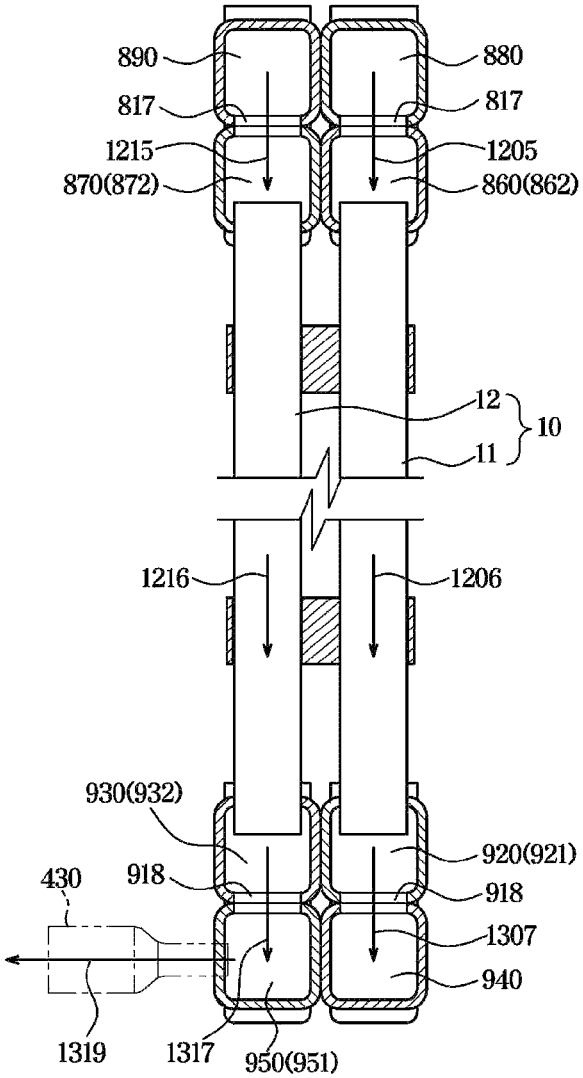
FIG. 24 is a side cross-sectional view illustrating flow of a refrigerant passing through tubes of a first column and tubes of a second column of the heat exchanger of FIG. 20.

FIG. 20 is a perspective view illustrating an outer appearance of a heat exchanger according to an embodiment of the disclosure. FIG. 21 is a front cross-sectional view illustrating flow of a refrigerant passing through tubes of a first column of the heat exchanger of FIG. 20, and FIG. 22 is a front cross-sectional view illustrating flow of a refrigerant passing through tubes of a second column of the heat exchanger of FIG. 20. FIG. 23 is a side cross-sectional view illustrating flow of a refrigerant passing through a first connecting pipe and a second connecting pipe of the heat exchanger of FIG. 20, and FIG. 24 is a side cross-sectional view illustrating flow of a refrigerant passing through the tubes of the first column and the tubes of the second column of the heat exchanger of FIG. 20.

In a heat exchanger 4 illustrated in FIG. 20, a plurality of heat exchange tubes 10, a first header 800, a first connecting pipe 520, and a second connecting pipe 620 may have the same configurations as the corresponding ones of the heat exchanger 3 illustrated in FIG. 15. Accordingly, descriptions about the heat exchange tubes 10, the first header 800, the first connecting pipe 520, and the second connecting pipe 620 will be omitted.

Referring to FIGS. 20 to 24, the heat exchanger 4 according to an embodiment of the disclosure may include the first header 800 and a second header 910 with which the plurality of heat exchange tubes 10 communicate respectively, an inlet pipe 330 through which an external refrigerant enters upon driving of a heating cycle and a refrigerant is discharged to outside upon driving of a cooling cycle, an outlet pipe 430 through which a refrigerant is discharged to outside upon driving of the heating cycle and an external refrigerant enters upon driving of the cooling cycle, and a first connecting pipe 520 and a second connecting pipe 620 connecting the first header 800 to the second header 910.

The first header 800 may be spaced a preset distance from the second header 910, and the heat exchange tubes 10 may be positioned between the first header 800 and the second header 910. The first header 800 may be positioned at upper ends of the heat exchange tubes 10, and the second header 910 may be positioned at lower ends of the heat exchange tubes 10.

One inlet pipe 330, one outlet pipe 430, one first connecting pipe 520, and one second connecting pipe 620 may be provided. A refrigerant may enter the first connecting pipe 520 through the inlet pipe 330 to be supplied to the first header 800, and a refrigerant may be discharged to outside from the second header 910 through the outlet pipe 430. Also, a refrigerant may flow from the second header 910 to the first header 800 through the second connecting pipe 620 without passing through the heat exchange tubes 10.

The first header 800, the second header 910, the first connecting pipe 520, and the second connecting pipe 620 may be coupled into one body by brazing. For brazing coupling, at least one of the first header 800, the second header 910, the first connecting pipe 520, and the second connecting pipe 620 may include a clad material.

The inlet pipe 320 may protrude from one end of the second header 910 in a direction that is parallel to an extension direction of the second header 910, and the outlet pipe 420 may protrude from a front or rear side of the heat exchanger 4. Thereby, it may be possible to easily perform brazing coupling after stably laying the heat exchanger 4 on the floor.

A diameter of the inlet pipe 330 may be larger than that of the outlet pipe 430. A high-temperature and high-pressure gas-phase refrigerant passed through a compressor (not shown) may enter the inlet pipe 330. The refrigerant entered the inlet pipe 330 may pass through the heat exchange tubes 10 to lose heat from outside and be condensed, and the condensed refrigerant may be discharged to the outside through the outlet pipe 430. Accordingly, in such a heating cycle, the heat exchanger 3 may function as a condenser.

In contrast, a low-temperature and low-pressure liquid-phase or gas-phase refrigerant passed through an expansion valve (not shown) may enter through the outlet pipe 430, and pass through the heat exchange tubes 10 to take away heat from outside and be evaporated. The evaporated refrigerant may be discharged to the outside through the inlet pipe 330. Accordingly, in such a cooling cycle, the heat exchanger 4 may function as an evaporator.

Hereinafter, a case in which the heat exchanger 4 according to an embodiment of the disclosure is used as a condenser will be mainly described. However, in the case in which a refrigerant circulates in the reverse cycle described above, the heat exchanger 4 may be used as an evaporator.

The second header 910 may include a plurality of chambers 920, 930, 940, and 950 along which a refrigerant flows. The second header 910 may be configured with four electric resistance welded pipes of which each forms a chamber and which are basically isolated from each other. The electric resistance welded pipes may be brazing-coupled with each other. The second header 910 may include a fifth chamber 920, a sixth chamber 930, a seventh chamber 940, and an eighth chamber 950.

The fifth chamber 920 may be connected to the heat exchange tubes 11 of the first column, and the sixth chamber 930 may be connected to the heat exchange tubes 12 of the second column. The fifth chamber 920 may be connected to the first connecting pipe 520, and the sixth chamber 930 may be connected to the second connecting pipe 620. The inlet pipe 330 may be connected to the fifth chamber 920. The outlet pipe 430 may be connected to the eighth chamber 950.

A plurality of cover baffles 830 may be respectively coupled with both ends of the second header 910 to close left and right ends of the fifth chamber 920, the sixth chamber 930, the seventh chamber 940, and the eighth chamber 950. The cover baffles 830 may be brazing-coupled with the second header 910. The cover baffles 830 may have the same shape and perform the same function.

The fifth chamber 920 may be partitioned into a first sub chamber 961 and a second sub chamber 962 by a partition baffle 850 coupled with the second header 910. The sixth chamber 930 may be partitioned into a first sub chamber 971 and a second sub chamber 972 by the partition baffle 850 coupled with the second header 910. The eighth chamber 950 may be partitioned into a first sub chamber 951 and a second sub chamber 952 by the partition baffle 850 coupled with the second header 910. The partition baffle 850 may be brazing-coupled with the second header 910.

The first sub chamber 961 of the fifth chamber 920 may be connected to the heat exchange tubes 11 of the first column (rear column), and the second sub chamber 962 of the fifth chamber 920 may be connected to the first connecting pipe 520. The first sub chamber 971 of the sixth chamber 930 may be connected to the heat exchange tubes 12 of the second column (front column), and the second sub chamber 972 of the sixth chamber 930 may be connected to the second connecting pipe 620.

The first connecting pipe 520 and the second connecting pipe 620 may be straight pipes having a section of a rectangular shape. The first connecting pipe 520 and the second connecting pipe 620 may be connected to the first header 800 and the second header 910 at both ends.

The first connecting pipe 520 may connect the second sub chamber 962 of the fifth chamber 920 to the second sub chamber 862 of the first chamber 860. The second connecting pipe 620 may connect the second sub chamber 972 of the sixth chamber 930 to the second sub chamber 872 of the second chamber 870. The first connecting pipe 520 may be in parallel to the heat exchange tubes 11 of the rear column (first column), the first chamber 860, and the third chamber 880. The second connecting pipe 620 may be in parallel to the heat exchange tubes 12 of the front column (second column), the second chamber 870, and the fourth chamber 890.

The inlet pipe 330 may be connected to the second sub chamber 922 of the fifth chamber 920.

The second header 910 may include at least one distribution hole 818 through which a refrigerant entered the first sub chamber 921 of the fifth chamber 920 flows to the seventh chamber 940. The second header 910 may include a through hole 917 through which the refrigerant entered the seventh chamber 940 flows to the second sub chamber 952 of the eighth chamber 950.

The second header 910 may include a through hole 817 through which the refrigerant entered the second sub chamber 952 of the eighth chamber 950 enters the second sub chamber 932 of the sixth chamber 930. The outlet pipe 430 may be connected to the first sub chamber 951 of the eighth chamber 950.

Lengths of the through holes 817 and 917 and the distribution hole 818 in a longitudinal direction of the second header 910 may be longer than lengths of the through holes 817 and 917 and the distribution hole 818 in a width direction of the second header 910. One through hole 817 or 917 may be formed in each chamber in each of the chambers 920, 930, 940, and 950, and a plurality of distribution holes 818 may be formed at preset intervals in each chamber in each of the chambers 920, 930, 940, and 950. In a flow of a refrigerant which will be described later, a refrigerant passing through the distribution hole 818 may be a liquid-phase refrigerant.

A refrigerant entered the first sub chamber 961 of the fifth chamber 920 from the heat exchange tubes 11 of the first column may equally enter an inside space of the seventh chamber 940 through the distribution hole 818. The refrigerant entered the seventh chamber 940 may flow to the second sub chamber 952 of the eighth chamber 950 through the through hole 917 and then be discharged to the second connecting pipe 620 through the through hole 817 and the second sub chamber 932 of the sixth chamber 930.

A refrigerant entered the first sub chamber 931 of the sixth chamber 930 from the heat exchange tubes 12 of the second column may equally enter the first sub chamber 951 of the eighth chamber 950 through the distribution hole 918. The refrigerant entered the first sub chamber 951 of the eighth chamber 950 may be discharged to the outlet pipe 430 connected to the first sub chamber 951 of the eighth chamber 950.

As a result, a refrigerant entered the fifth chamber 920 through the heat exchange tubes 11 of the first column may be uniformly dispersed and discharged to the second connecting pipe 620, and a refrigerant entered the sixth chamber 930 through the heat exchange tubes 12 of the second column may be uniformly dispersed and discharged to the outlet pipe 430.

Also, refrigerants entered the seventh chamber 940 and the second sub chamber 952 of the eighth chamber 950 may be mixed and stabilized in the seventh chamber 940 and the second sub chamber 952 of the eighth chamber 950, before flowing to the second sub chamber 932 of the sixth chamber 930. Also, refrigerants entered the second sub chamber 922 of the fifth chamber 920 and the second sub chamber 932 of the sixth chamber 930 may be again mixed and stabilized in the second sub chamber 922 of the fifth chamber 920 and the second sub chamber 932 of the sixth chamber 930, before flowing to the first connecting pipe 520 and the second connecting pipe 620. Accordingly, distribution and heat exchange efficiency of refrigerants may increase.

A refrigerant may enter the second sub chamber 922 of the fifth chamber 920 through the inlet pipe 330 (1300). The refrigerant entered the second sub chamber 922 of the fifth chamber 920 may enter the first connecting pipe 520 (1301). The refrigerant entered the first connecting pipe 520 may flow along the first connecting pipe 520 (1202), and then enter the third chamber 880 via the second sub chamber 862 of the first chamber 860 (1203). The refrigerant entered the third chamber 880 may flow along the third chamber 880 (1204), and then be distributed through the first sub chamber 861 of the first chamber 860 through the distribution hole 818 (1205).

The refrigerant distributed to the first sub chamber 861 of the first chamber 860 may be equally distributed to the heat exchange tubes 11 of the first column. The refrigerant may exchange heat with outside air, while flowing along the inside of the heat exchange tubes 11 of the first column (1206), and then enter the first sub chamber 921 of the fifth chamber 920. The refrigerant entered the first sub chamber 921 of the fifth chamber 920 may enter the seventh chamber 940 through the distribution hole 818 (1307).

The refrigerant entered the seventh chamber 940 may flow along the seventh chamber 940 (1308), and then enter the second sub chamber 952 of the eighth chamber 950 through the through hole 917 (1309). The refrigerant entered the second sub chamber 952 of the eighth chamber 950 may enter the second connecting pipe 620 via the second sub chamber 932 of the sixth chamber 930 via the through hole 817 (1310). The refrigerant may flow along the second connecting pipe 620 (1212), and then enter the fourth chamber 890 via the second sub chamber 872 of the second chamber 870 (1213). The refrigerant entered the fourth chamber 890 may flow along the fourth chamber 890 (1214) and be discharged to the first sub chamber 871 of the second chamber 870 through the distribution hole 818 (1215).

The refrigerant distributed to the first sub chamber 871 of the second chamber 870 may be equally distributed to the heat exchange tubes 12 of the second column. The refrigerant may exchange heat with outside air, while flowing along the inside of the heat exchange tubes 12 of the second column (1216), and then enter the first sub chamber 931 of the sixth chamber 930. The refrigerant entered the first sub chamber 931 of the sixth chamber 930 may enter the first sub chamber 951 of the eighth chamber 950 through the distribution hole 918 (1317). The refrigerant may flow along the first sub chamber 951 of the eighth chamber 950 (1318), and then be discharged to the outside of the heat exchanger 4 through the outlet pipe 430 connected to the first sub chamber 951 of the eighth chamber 950 (1319).

A flow of a refrigerant, as described above, relates to a case in which a heat exchanger according to an embodiment of the disclosure is used as a condenser, that is, a case in which the heat exchanger is driven according to a cooling cycle. In the case in which the heat exchanger is used as a condenser, a high-temperature and high-pressure liquid-phase refrigerant may be used. The refrigerant may lose heat from outside while passing through the heat exchange tubes 10 to be condensed. The heat exchanger according to an embodiment of the disclosure may circulate the refrigerant in the direction of gravity to exchange heat with outside air, then move a part of the condensed refrigerant to a first header provided at the upper ends of the heat exchange tubes through a second connecting pipe, and again circulate the refrigerant through the heat exchange tubes 10 in the direction of gravity to exchange heat with outside air. Thereby, the heat exchanger may prevent increases of viscosity and density caused by condensation of the refrigerant from acting as resistance against the flow of the refrigerant.

Also, because the headers provided at the upper and lower ends of the heat exchange tubes 10 include a plurality of partitioned chambers, a refrigerant may be distributed, mixed, and stabilized whenever passing through each chamber, and accordingly, circulation of refrigerants may be improved and heat exchange efficiency may increase.

Meanwhile, when a refrigerant circulates in the reverse cycle in the heat exchanger according to an embodiment of the disclosure, the heat exchanger may be used as an evaporator and driven according to a cooling cycle.

When the heat exchanger is used as an evaporator, a low-temperature and low-pressure liquid-phase refrigerant may enter through an outlet pipe. The liquid-phase refrigerant may pass through the heat exchange tubes 10 to lose heat from outside and be evaporated. When the heat exchanger according to an embodiment of the disclosure is driven according to a cooling cycle, a refrigerant may flow in the opposite direction of gravity in all of the heat exchange tubes 11 and 12 of the first column and the second column. Thereby, the evaporated refrigerant may circulate easily in the heat exchanger.

Also, like when a heating cycle is driven, a refrigerant may be distributed, mixed, and stabilized whenever passing through the plurality of partitioned chambers of the headers provided in the upper and lower ends of the heat exchange tubes 10, and accordingly, circulation of refrigerants may be improved and heat exchange efficiency may increase.

Although the technical idea of the disclosure has been described above with reference to specific embodiments, the scope of rights of the disclosure is not limited to these embodiments.

It should be interpreted that various embodiments modified or changed by a person skilled in the art within a scope not deviating from the gist of the disclosure as the technical concept of the disclosure, which is defined in the claims, also belong to the scope of rights of the disclosure.

The invention claimed is:

1. A heat exchanger comprising:

a plurality of heat exchange tubes along which a refrigerant flows to exchange heat with outside air, the plurality of heat exchange tubes including a plurality of tubes of a first column and a plurality of tubes of a second column;

a first header to which upper ends of the plurality of heat exchange tubes are connected;

a second header to which lower ends of the heat exchange tubes are connected;

an inlet pipe protruding in a first direction from a first side of the heat exchanger which a refrigerant enters from outside the inlet pipe;

an outlet pipe protruding in the first direction from the first side of the heat exchanger through which a refrigerant is discharged to outside the outlet pipe;

a first connecting pipe through which the refrigerant entered the inlet pipe flows to the first header; and a second connecting pipe through which a refrigerant flows from the second header to the first header without passing through the plurality of heat exchange tubes, wherein the first header, the second header, the first connecting pipe, and the second connecting pipe are coupled with each other by brazing, and wherein the first connecting pipe is positioned behind the second connecting pipe, and the inlet pipe penetrates the second connecting pipe to be connected to the first connecting pipe.

2. The heat exchanger of claim 1, wherein at least one of the first header, the second header, the first connecting pipe, and the second connecting pipe includes a clad material for brazing coupling.

3. The heat exchanger of claim 1, wherein the first connecting pipe and the second connecting pipe have a section of a rectangular shape.

4. The heat exchanger of claim 1, wherein the first connecting pipe and the second connecting pipe are formed in a shape of a straight line, and the first connecting pipe and the second connecting pipe are connected to the first header and the second header at both ends.

5. The heat exchanger of claim 1, wherein the outlet pipe is connected to the second connecting pipe or the second header.

6. The heat exchanger of claim 1, wherein the inlet pipe is connected to the second header.

7. The heat exchanger of claim 1, further comprising a third connecting pipe connecting the first connecting pipe to the second connecting pipe.

8. The heat exchanger of claim 1, wherein the inlet pipe protrudes from one end of the second header in a direction that is parallel to an extension direction of the second header.

9. The heat exchanger of claim 1, wherein the first header comprises:

a first chamber including a first sub chamber connected to the plurality of tubes of the first column and a second sub chamber connected to the first connecting pipe;

a second chamber including a third sub chamber connected to the plurality of tubes of the second column and a fourth sub chamber connected to the second connecting pipe;

a third chamber positioned above the first chamber and distributing a refrigerant to the first sub chamber; and a fourth chamber positioned above the second chamber and distributing a refrigerant to the third sub chamber, wherein the second header comprises:

a fifth chamber including a fifth sub chamber connected to the plurality of tubes of the first column, and a sixth sub chamber isolated from the fifth sub chamber;

a sixth chamber including a seventh sub chamber connected to the plurality of tubes of the second column, and an eighth sub chamber isolated from the seventh sub chamber;

a seventh chamber positioned below the fifth chamber, wherein a refrigerant flown to the fifth sub chamber is collected in the seventh chamber; and an eighth chamber positioned below the sixth chamber.

10. The heat exchanger of claim 9, wherein the second connecting pipe connects the sixth sub chamber to the fourth sub chamber.

11. The heat exchanger of claim 9, wherein the second connecting pipe connects the eighth sub chamber to the fourth sub chamber.

12. The heat exchanger of claim 9, wherein the seventh chamber comprises:

a ninth sub chamber in which the refrigerant flown to the fifth sub chamber is collected; and a tenth sub chamber isolated from the ninth sub chamber, and communicating with the sixth sub chamber, wherein the eighth chamber communicates with the eighth sub chamber and the ninth sub chamber, the inlet pipe penetrates the eighth chamber to be connected to the tenth sub chamber, and the outlet pipe is connected to the seventh sub chamber.

13. The heat exchanger of claim 9, wherein the eighth chamber comprises:

a ninth sub chamber in which the refrigerant flown to the seventh sub chamber is collected; and a tenth sub chamber isolated from the ninth sub chamber, and communicating with the eighth sub chamber, wherein the tenth sub chamber communicates with the seventh chamber and the eighth sub chamber, the inlet pipe is connected to the sixth sub chamber, and the outlet pipe is connected to the ninth sub chamber.

* * * * *